US008557487B2

(12) United States Patent
Kami et al.

(10) Patent No.: US 8,557,487 B2
(45) Date of Patent: Oct. 15, 2013

(54) ELECTROPHOTOGRAPHIC PHOTOCONDUCTOR, METHOD FOR PRODUCING ELECTROPHOTOGRAPHIC PHOTOCONDUCTOR, AND IMAGE FORMING APPARATUS

(75) Inventors: Hidetoshi Kami, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 354 days.

(21) Appl. No.: 12/892,526

(22) Filed: Sep. 28, 2010

(65) Prior Publication Data

US 2011/0076057 A1 Mar. 31, 2011

(30) Foreign Application Priority Data

Sep. 29, 2009 (JP) ..... 2009-223742

(51) Int. Cl.
*G03G 5/00* (2006.01)

(52) U.S. Cl.
USPC ..... 430/66; 430/56; 399/346; 399/350

(58) Field of Classification Search
USPC ..... 399/346, 350; 430/66, 56
See application file for complete search history.

(56) References Cited

U.S. PATENT DOCUMENTS

| | | | | |
|---|---|---|---|---|
| 5,114,814 | A * | 5/1992 | Sakoh et al. | 430/45.54 |
| 5,242,776 | A * | 9/1993 | Doi et al. | 430/67 |
| 5,381,211 | A * | 1/1995 | Godlove | 399/159 |
| 7,186,489 | B2 * | 3/2007 | Uematsu et al. | 430/66 |
| 7,226,711 | B2 * | 6/2007 | Amamiya et al. | 430/58.7 |
| 7,813,675 | B2 * | 10/2010 | Tanabe et al. | 399/159 |
| 2010/0119260 | A1 | 5/2010 | Egawa et al. | |
| 2011/0135340 | A1 * | 6/2011 | Uematsu et al. | 399/111 |

FOREIGN PATENT DOCUMENTS

| | | |
|---|---|---|
| JP | 51-129237 | 11/1976 |
| JP | 57-94772 | 6/1982 |
| JP | 59-13241 | 1/1984 |
| JP | 60-202446 | 10/1985 |
| JP | 63-106757 | 5/1988 |
| JP | 2000-66424 | 3/2000 |
| JP | 2000-171990 | 6/2000 |
| JP | 2001066814 A * | 3/2001 |
| JP | 2006-337687 | 12/2006 |
| JP | 2007-79244 | 3/2007 |

(Continued)

OTHER PUBLICATIONS

English language machine translation of JP 2001-066814 (Mar. 2001).*

(Continued)

*Primary Examiner* — Christopher Rodee
(74) *Attorney, Agent, or Firm* — Oblon, Spivak, McClelland, Maier & Neustadt, L.L.P.

(57) ABSTRACT

To provide an electrophotographic photoconductor including: a conductive substrate; a photosensitive layer; and a surface layer having grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor.

10 Claims, 8 Drawing Sheets

(56) References Cited

FOREIGN PATENT DOCUMENTS

| | | |
|---|---|---|
| JP | 2007-121908 | 5/2007 |
| JP | 4169726 | 8/2008 |
| JP | 2008-299261 | 12/2008 |

OTHER PUBLICATIONS

Diamond, Arthur S. (ed.) Handbook of Imaging Materials. New York: Marcel-Dekker, Inc. (1991) pp. 145-164.*

Nobuo Hyakutake, et al. "Blade cleaning system for polymerized and small size toner." Japan Hardcopy Fall Meeting. 2001. p. 24-27.

* cited by examiner

ELECTROPHOTOGRAPHIC PHOTOCONDUCTOR, METHOD FOR PRODUCING ELECTROPHOTOGRAPHIC PHOTOCONDUCTOR, AND IMAGE FORMING APPARATUS

BACKGROUND OF THE INVENTION

1. Field of the Invention

The present invention relates to an electrophotographic photoconductor and an image forming apparatus. The image forming apparatus of the present invention can be favorably applied to copiers, facsimiles, laser printers, direct digital platemakers and the like.

2. Description of the Related Art

Although electrophotographic photoconductors for use in photocopiers, laser printers and the like were formerly dominated by inorganic photoconductors such as those including selenium, zinc oxide, cadmium sulfide, etc., organic photoconductors (OPCs), which are more advantageous than the inorganic photoconductors in terms of reduction in load on the global environment, cost reduction and high design freedom, are most popular at present. The organic photoconductors are currently used at a rate that is close to 100% of the total production volume of electrophotographic photoconductors. In response to the present-day protection of the global environment, the role of the organic photoconductors is required to change from that of consumable supplies (disposable products) to mechanical components.

In the past, various attempts have been made to impart high durability to organic photoconductors. At present, formation of a cross-linked resin film on a photoconductor surface (e.g., Japanese Patent Application Laid-Open (JP-A) No. 2000-66424) and formation of a sol-gel cured film on a photoconductor surface (e.g., JP-A No. 2000-171990) are deemed particularly promising. The former has an advantage in that the photoconductor surface does not easily allow breaks or cracks to be formed therein even when a charge transporting constituent is mixed in the film forming composition, and a reduction in production yield can be prevented. In particular, use of a radically polymerizable acrylic resin is advantageous because a photoconductor having high strength and excellent photosensitive properties is easily obtained. In these two methods utilizing cross-linked structure, a coating film is formed by a plurality of chemical bonds, and thus even when the coating film receives physical stress and part of the chemical bonds is cut, this does not soon lead to abrasion (wear) of the photoconductor surface.

In addition, the use of polymerization toners (spherical toners) is becoming increasingly common for the toners for development used in electrophotography for reasons of improved reduction in the load on the environment during toner production as well as being advantageous in terms of achieving high image quality.

These polymerization toners (spherical toner) are spherically shaped toners that are free of corners, and are produced by chemical production processes such as suspension polymerization, emulsion aggregation polymerization, ester elongation polymerization and dissolution suspension. The polymerization toners vary in shape depending on the production process, and the polymerization toner used in image forming apparatuses has a shape that is slightly distorted from being perfectly round. Typical characteristic values consist of an average circularity of 0.95 to 0.99, values of 110 to 140 for shape factors SF-1 and SF-2. Those having an average circularity of 1.0 and a value of 100 for the shape factors SF-1 and SF-2 are perfectly round.

Since polymerization toners have a uniform shape, the charge they possess can be relatively easily made uniform. In addition, wax and the like can be easily added into the polymerization toners. Thus, since there is hardly any overflow of the polymerization toners from latent electrostatic images, the polymerization toners have satisfactory developing ability, superior sharpness, superior resolution, superior contrast and satisfactory transfer efficiency. In addition, they also have numerous advantages such as oil-less transfer. On the other hand, toners of this type are known to be associated with difficulties in cleaning, and troubles such as fish-shaped filming on photoconductors as a result of an increase in the amount of an external additive in relation to the oil-less transfer. Accordingly, numerous countermeasures against the foregoing have been proposed in patent literatures and the like.

In general, in order to ensure adequate cleanability for the polymerization toners, it is desirable that the surface of the photoconductor have a low friction coefficient and that the friction coefficient be maintained during repeated use. For example, cleanability for a polymerization toner is known to be secured by coating the surface of a photoconductor with a solid lubricant such as zinc stearate (Nobuo Hyakutake, Akihisa Maruyama, Satoru Shigesaki, Sachie Okuyama: Japan Hardcopy Fall Meeting, 24-27, 2001).

However, when a solid lubricant such as zinc stearate is externally supplied to a highly durable electrophotographic photoconductor with the radically polymerizable acrylic cross-linked film, there is a problem in which the solid lubricant cannot be not fully accepted by the photoconductor surface. In many cases, photoconductors of this type have smooth surfaces. Therefore, the defect of acceptability is attributable to the smoothness of the photoconductor surface.

Meanwhile, JP-A No. 2007-121908 proposes use of a mixture of (A) a fatty acid metal salt and a lubricant powder material (B) (which is made of at least one lubricative material selected from melamine cyanurate, ethylene polytetrafluoride, molybdenum disulfate and a fatty acid amide) for a lubricant coat film in an image bearing member where a lubricant coat film is formed on a photosensitive layer surface which bears a latent image. It is noteworthy that a surface protective layer having a large number of depressions and protrusions on its surface is provided between the photosensitive layer and the lubricant coat film. As described in the paragraph [0068] of JP-A No. 2007-121908, by forming the depressions and protrusions as the surface configuration of a photoconductor, it is expected that the adhesive force of the lubricant coat film will be increased and that the amount of shaving off of the lubricant caused by a cleaning blade will be reduced.

However, JP-A No. 2007-121908 does not explain the configuration of the depressions and protrusions of the photoconductor surface, except for the expression 10 nm<Rz<5,000 nm in measurement with the measurement length of 10 μm, and thus it is still unclear specifically what depressions and protrusions should be provided on the photoconductor, although it is understandable that if a photoconductor has a smooth surface, it causes difficulties. For example, even if the value Rz (surface roughness) is constant, the value Rz is calculated as an average value, and thus a photoconductor surface can have a variety of surface configurations. Therefore, it cannot be said that the description is practically defined. In addition, the improvement in adhesive force between the lubricant and the photoconductor may bring about another problem with removability of degraded lubricant.

JP-A No. 57-94772 proposes a surface treatment method for an organic electrophotographic photoconductor, in which a lubricant made of a low-surface-energy substance is directly applied to the organic electrophotographic photoconductor surface or the lubricant is incorporated into a dry developer and indirectly applied to the organic electrophotographic photoconductor surface, thereby improving cleaning effects, wherein the organic electrophotographic photoconductor surface is treated with a metal wire (13 μm to 20 μm in diameter) made of a material and selected from tungsten, molybdenum, nickel and stainless steel to form in the photoconductor surface a large number of grooves in the form of thin lines.

In this proposed technique, the method of forming the grooves in the photoconductor surface causes scratches to form in the photoconductor surface by means of the metal wire, and treatment of powder generated by the cutting, and the formation of the grooves are arbitrarily carried out depending on the situation. For this reason, it is considered difficult to produce photoconductors having the same surface configuration. Moreover, since the grooves in the form of thin lines have a pitch of 4 μm to 9 μm and the groove pattern is similar to the concavo-convex pattern seen on the surface of ground glass, the lubricant will be brought into line-contact with the photoconductor unless the lubricant is greatly reduced in particle diameter, and this may lead to insufficient adhesion of the lubricant to the photoconductor. In other words, the photoconductor surface may become a surface to which the lubricant is not easily attached.

JP-A No. 57-94772 discloses a technique wherein minute depressions present in the surface of a photoconductive material layer of a photoconductor in which a photoconductive material is attached to and formed on a substrate are filled with a selected material so as to flatten the photoconductor surface.

When the depressions (grooves) are provided in the photoconductor surface and a lubricant can be supplied to and removed from the depressions, it is, apparently, expected that high lubricating properties of the photoconductor will be sustained. JP-A No. 57-94772 proposes to embed, in the depressions, a material having electric resistance that is as high as that of the photoconductor surface in which the depressions are to be formed, for the purpose of preventing formation of abnormal images attributable to the depressions. From a different viewpoint, the following can be said: when depressions are formed in a material having high resistance, such as a solid solution containing a charge transporting material and polycarbonate generally used in a charge transporting layer, there are great effects caused by the depressions in terms of electrostatic properties and thus abnormal images are easily formed. Therefore, countermeasures against this problem are needed. Accordingly, attempts have been keenly made to strengthen the surfaces of organic photoconductors for the purpose of preventing formation of such abnormal images.

The techniques described in JP-A Nos. 2007-121908 and 57-94772 are conventional techniques relating to a combination of a specific surface configuration of a photoconductor and a lubricant. It is known that a lubricant is degraded by a charging step in an electrophotographic process. When the degraded lubricant unnecessarily remains on the photoconductor surface, there are problems caused such as an increase in driving torque of the photoconductor and breakdowns of members (a cleaning blade and the like) which rub against the photoconductor. The lubricant needs to be circulated such that it is appropriately supplied to and removed from the photoconductor surface; in related art, however, the techniques for enhancing the circulation efficiency are still insufficient.

JP-A No. 2006-11047 discloses an electrophotographic photoconductor in which countless linear scratches that intersect each other are uniformly formed on an reinforced surface of the photoconductor. The invention disclosed in JP-A No. 2006-11047 is originally a technique of performing surface treatment for the purpose of preventing formation of abnormal images, and so it cannot be directly applied to improvement in the applicability of a lubricant, which is a different purpose. Specifically, this is because the average width of the linear scratches is 10 μm or less and thus it is feared that the fixability of the lubricant could be insufficient, similarly to the case of JP-A No. 57-94772. In relation to the fact that (even though the photoconductor is provided with the reinforced surface) the photoconductor is more or less used in a process associated with abrasion, in the case where the photoconductor is utilized in an electrophotographic apparatus, JP-A No. 2006-11047 proposes that the photoconductor be used together with a surface shape reproducing device provided in the electrophotographic apparatus.

Methods for providing a photoconductor surface with a specific patterned shape have been known in the art for a long time. For example, JP-A No. 51-129237 discloses a method of partially irradiating the surface of a resin coating film (ionizing radiation curable resin coating film) with ionizing radiation through a wire gauze, a metal plate with countless small holes formed therein, a metal plate perforated in a patterned manner, or a metal frame corresponding to an irradiation pattern. In this case, however, it is necessary to take the trouble to dissolve uncured portions. Moreover, equipment needs to be designed in a manner that prevents the ionizing radiation from entering masked portions.

JP-A 63-106757 proposes patterning of a photoconductor whose outermost surface is provided with a plurality of depressions (grooves) each having a depth of $\lambda/4$ or greater ($\lambda$ denotes a coherent exposure wavelength). Suppression of the formation of moire-related abnormal images is intended by forming the depressions with a specific period. This proposal is only aimed at preventing moire and thus does not pay attention to variation in the depth of the grooves. Moreover, since the pattern is formed on polycarbonate (which is relatively easily abraded) and formed using a metal brush, this proposal is deficient in durability and patterning uniformity.

The techniques disclosed in JP-A Nos. 2006-11047, 51-129237 and 63-106757, which have been described above, are typical prior-art techniques for forming a specific shape on the photoconductor surface. In the case where the shape is formed by scratching the photoconductor surface, however, it is difficult to always form the same pattern. It is also difficult to form such a uniform pattern as enlarges areas separated from each another by the grooves.

JP-A No. 60-202446 proposes a method of forming a mosaic filter of three primary colors on a photoconductor by ink jetting, as a production method of a one shot color electrophotographic photoconductor. It is explained that the mosaic pattern is a line pattern having a width of 100 μm and a thickness of 1 μm. Further, it proposes a special coating theory using an inkjet method. In the case where coating is performed by ink jetting, droplets of an ink may not be able to be ejected from an inkjet head or the droplets may be repelled by a base, unless the base and the ink are appropriately adjusted. It is not easy to realize coating by an inkjet method. Especially when the base is formed of a sparingly soluble curable resin and a silicone oil is attached to the surface thereof, the droplets are significantly repelled by the silicone oil.

JP-A No. 2006-337687 discloses a method of forming a protective layer, using an inkjet method. This method shows that the employment of coating by an inkjet method achieves an increase in the pot life of a thermosetting coating material, which starts reacting once two liquids are mixed together, and high production efficiency. A satisfactory protective layer can be formed with a thin film, and the coating material can be prepared using monomer component(s) only, without using any polymer components; this enables the coating by an inkjet method.

Similarly to the technique disclosed in JP-A No. 2006-337687, JP-A No. 2008-299261 discloses a technique which uses an inkjet method in forming a curable resin film. The pot life of a coating material can be increased by jetting two liquids to be cured, from separate droplet ejection heads. Also, by controlling the amounts of the two liquids ejected, utilizing an inkjet method, regulations can be realized such as provision of a bias to the ratio between the two liquids contained in the film. However, in order to stabilize the ejection of the liquids from the inkjet heads, the liquids often need ejecting for test purposes. For this reason, the coating efficiency is not necessarily high.

The techniques disclosed in JP-A Nos. 60-202446, 2006-337687 and 2008-299261, which have been described above, are typical related-art techniques related to film formation at the photoconductor surface by an inkjet method. These techniques have possibilities in the production of a surface layer of a photoconductor by an inkjet method; however, related art leaves some problems unsolved concerning the repellence of droplets ejected from inkjet head(s) and the ejection stability of the droplets themselves.

As described above, the related art cannot sufficiently enhance circulation of a lubricant supplied onto and removed from the surface of a photoconductor, and thus high durability of an electrophotographic photoconductor and cleaning stability of an electrophotographic apparatus have yet to be obtained.

BRIEF SUMMARY OF THE INVENTION

It is expected that the durability of an electrophotographic photoconductor can be dramatically improved by producing a cross-linked resin film. In recent years, the difficulty in securing cleanability in relation to polymerization toners that are vastly popular as developers has been a grave technical problem. As a way of solving this problem, application of a lubricant over the surface of a photoconductor is advantageous. However, in the case of an electrophotographic photoconductor in which a cross-linked resin film is provided as the outermost surface, the applicability of the lubricant over the electrophotographic photoconductor is poor, and thus the excellent durability yielded by the cross-linked resin film cannot be ideally exhibited.

Specifically, when the lubricant remains excessively on the photoconductor surface, a degraded part of the lubricant directly causes image noise, and/or a cleaning blade which rubs against the photoconductor is abraded, thereby leading to cleaning failure in some cases. Moreover, when the consumption of the lubricant cannot be reduced, frequent replacement of the lubricant is required.

Accordingly, the present invention is aimed at improving circulation of a lubricant which is supplied onto and removed from a highly durable electrophotographic photoconductor including a cross-linked surface layer. The improvement makes it possible to lengthen the lifetime of the electrophotographic photoconductor and an image forming apparatus and thus to reduce printing costs.

Means for solving the problems are as follows.

<1> An electrophotographic photoconductor including: a conductive substrate; a photosensitive layer; and a surface layer having grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor.

<2> The electrophotographic photoconductor according to <1>, wherein bottom portions of the grooves and areas separated from each other by the grooves contain a resin having a cross-linked structure with charge transporting properties.

<3> The electrophotographic photoconductor according to <1>, wherein the surface layer contains an acrylic leveling agent.

<4> The electrophotographic photoconductor according to <1>, wherein the surface layer has an acrylate structural unit containing an acryloyloxy group, and a charge transporting structural unit.

<5> The electrophotographic photoconductor according to <1>, wherein bottom portions of the grooves and areas separated from each other by the grooves contain a metal oxide filler.

<6> A method for producing an electrophotographic photoconductor, including: forming a surface layer having grooves which do not intersect each other, by applying droplets from a droplet ejection head in accordance with an inkjet method, wherein the electrophotographic photoconductor includes: a conductive substrate; a photosensitive layer; and the surface layer having the grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor.

<7> The method according to <6>, wherein bottom portions of the grooves and areas separated from each other by the grooves contain a resin having a cross-linked structure with charge transporting properties.

<8> The method according to <6>, wherein the surface layer contains an acrylic leveling agent.

<9> The method according to <6>, wherein the surface layer has an acrylate structural unit containing an acryloyloxy group, and a charge transporting structural unit.

<10> The method according to <6>, wherein bottom portions of the grooves and areas separated from each other by the grooves contain a metal oxide filler.

<11> An image forming apparatus including: at least one image forming unit which includes an electrophotographic photoconductor and a lubricant applying unit, wherein the lubricant applying unit includes a unit configured to sweep off a lubricant with a roller brush and transfer the lubricant to a surface of the electrophotographic photoconductor, and also includes a blade with which the transferred lubricant is uniformly applied over the surface of the electrophotographic photoconductor, wherein the electrophotographic photoconductor includes: a conductive substrate; a photosensitive layer; and a surface layer having grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor.

<12> The image forming apparatus according to <11>, wherein bottom portions of the grooves and areas separated from each other by the grooves contain a resin having a cross-linked structure with charge transporting properties.

<13> The image forming apparatus according to <11>, wherein the surface layer contains an acrylic leveling agent.

<14> The image forming apparatus according to <11>, wherein the surface layer has an acrylate structural unit containing an acryloyloxy group, and a charge transporting structural unit.

<15> The image forming apparatus according to <11>, wherein bottom portions of the grooves and areas separated from each other by the grooves contain a metal oxide filler.

As is evident from the detailed and specific explanations below, an electrophotographic photoconductor of the present invention is superior in acceptance and removal of a lubricant, and an image forming apparatus of the present invention is superior in circulation of a lubricant which is supplied onto and removed from an electrophotographic photoconductor.

DETAILED DESCRIPTION OF THE INVENTION

In an attempt to solve the problems, the present inventors have considered in an organized manner a mechanism of application of a solid lubricant onto the surface of an electrophotographic photoconductor in an electrophotographic process, and devised requirements for an electrophotographic photoconductor suitable for the application process. Also, they have considered means (units) necessary to realize the foregoing. The following explains the mechanism, the requirements and the means (units) in this order.

First of all, a mechanism of application of a solid lubricant onto the surface of an electrophotographic photoconductor in an electrophotographic process has been considered in an organized manner.

Generally, a very small amount of a lubricant is supplied in powder form onto the surface of an electrophotographic photoconductor each time. As for a specific method of supplying the lubricant, it is thought that a method of shaving a very small amount off a block of a solid lubricant each time and thusly applying the solid lubricant, by means of an applying unit such as a brush, (as disclosed in JP-A No. 2000-162881) enables simplification of the apparatus structure and stable supply of the lubricant over the entire surface of an electrophotographic photoconductor.

Figure 10:
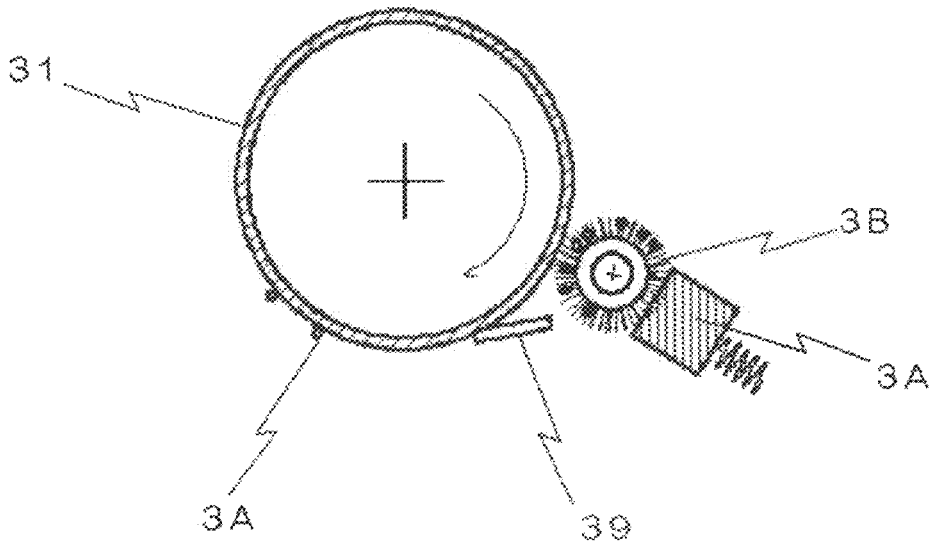
FIG. 10 is a schematic cross-sectional view showing another example of a unit configured to supply a lubricant onto an electrophotographic photoconductor.

FIG. 10 shows an example of the structure of a lubricant supplying device. A solid lubricant 3A is applied over a photoconductor 31 by means of an application brush (such as a rotatable fur brush) 3B. The application brush 3B rotates in such a manner as to touch the solid lubricant 3A and shaves off part of the solid lubricant. The shaved-off part of the solid lubricant 3A is attached to an application blade 39 and applied over the photoconductor 31 in a rotational manner. The solid lubricant 3A applied over the photoconductor 31 is spread over the photoconductor surface by means of the application blade 39. In the case where a solid lubricant is applied over a photoconductor surface by means of an application brush or the like, the lubricant is applied in powder form over the photoconductor surface; note that the lubricant in this state cannot fully exhibit its lubricity. It is necessary to spread the lubricant over the photoconductor surface by the application brush or the like. By forming the lubricant into a film present over the photoconductor surface in this process, its lubricity can be favorably exhibited.

As the solid lubricant 3A, a metal salt of a higher fatty acid, such as zinc stearate, is generally used. Zinc stearate is a typical lamella crystal powder, and use of such a substance as the lubricant is preferable. Lamella crystals have a layered structure with self-assembled amphiphilic molecules, and the crystals easily break up along portions between layers upon application of shearing force, thereby yielding slipperiness. The foregoing action yields an effect of reducing the friction coefficient and, since the lamella crystals uniformly cover the photoconductor surface upon application of shearing force (which is characteristic of the lamella crystals), the photoconductor surface can be effectively covered with a small amount of the lubricant.

When a lubricant is applied by this method, there are various ways of controlling the applied state of the lubricant. For example, it is possible to employ a means of increasing the contact pressure between a solid lubricant and an application brush, or a means of controlling the rotational speed of the application brush. Also, an attempt may be made to control the number of revolutions of the application brush according to information on image formation.

Next, requirements for an electrophotographic photoconductor suitable for the lubricant applying process have been examined.

In such a lubricant applying mechanism, an electrophotographic photoconductor is required to allow a lubricant to be highly sensitively attached to the electrophotographic photoconductor upon supply of the lubricant. The sensitivity related to the attachment of the solid lubricant is thought to be affected at least by the attachment force between the photoconductor and the lubricant and the extent to which the lubricant can be easily formed into a film by an application blade.

Attachment force between two objects is examined, for example, in "KONICA MINOLTA TECHNOLOGY REPORT Vol. 1, 19-22, 2004" by Yukiko Mizuguchi and Takahito Miyamoto. The attachment force is thought to be affected by nonelectrostatic attraction, electrostatic attraction and the contact area between the two objects. For example, the electrostatic attraction is thought to be exhibited by contact potential difference, and the nonelectrostatic attraction is thought to be exhibited in relation to surface energy (e.g. wettability).

Originally, lubricants were not firmly attachable, and the attachment force between a lubricant and a photoconductor surface could not be greatly changed even if the photoconductor surface contained any surface conditioner. The present inventors have considered, as another factor ρ, an effect obtained by roughening a photoconductor surface, which is related to the contact area between a lubricant and the photoconductor surface.

Figure 11:
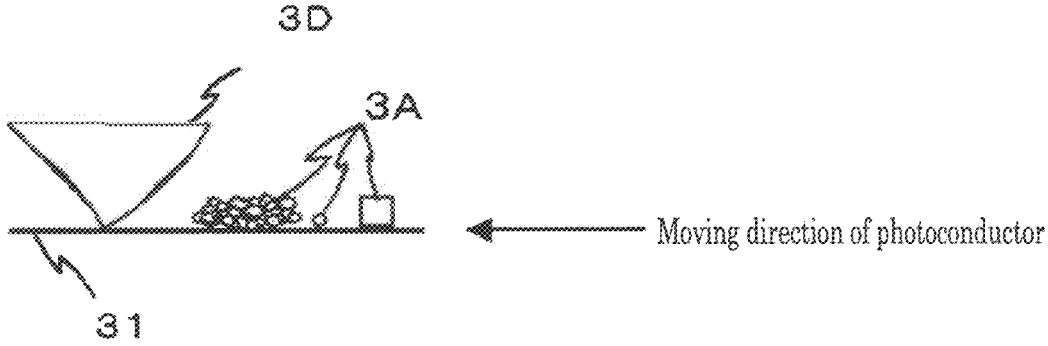
FIG. 11 is a schematic drawing showing a state in which a lubricant is attached to an electrophotographic photoconductor.
Figure 12:
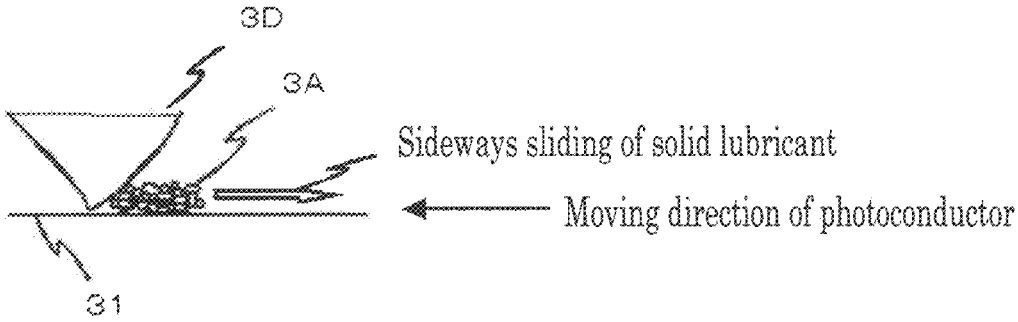
FIG. 12 is a drawing showing an example of poor applicability of a lubricant onto an electrophotographic photoconductor.
Figure 13:
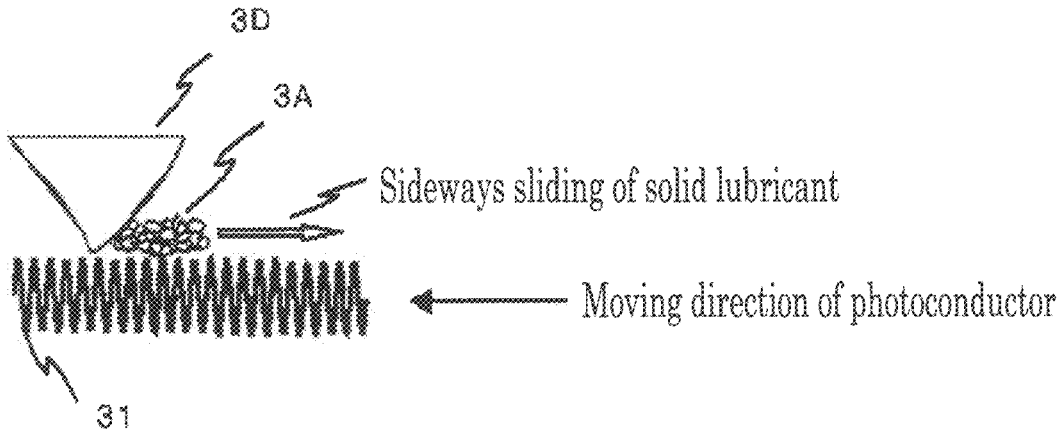
FIG. 13 is a drawing showing another example of poor applicability of a lubricant onto an electrophotographic photoconductor.

FIG. 11 represents an example of an effect of a surface shape, showing a state in which a lubricant in powder form, swept off by an application brush, is attached as an aggregate or one solid shape to a photoconductor surface. In the case where the photoconductor surface is smooth, it is thought possible that the lubricant slides sideways instead of passing through an application blade and then comes off the photoconductor surface, as shown in FIG. 12. Meanwhile, in the case where the photoconductor surface has extreme depressions and protrusions as shown in FIG. 13, the lubricant comes into point-contact with the photoconductor, and thus it is thought that the lubricant easily comes off the photoconductor surface in this case as well. In FIGS. 11 to 15, the reference numeral 31 denotes a photoconductor surface, the symbol 3A denotes a solid lubricant, and the symbol 3D denotes an application blade edge.

Figure 14:
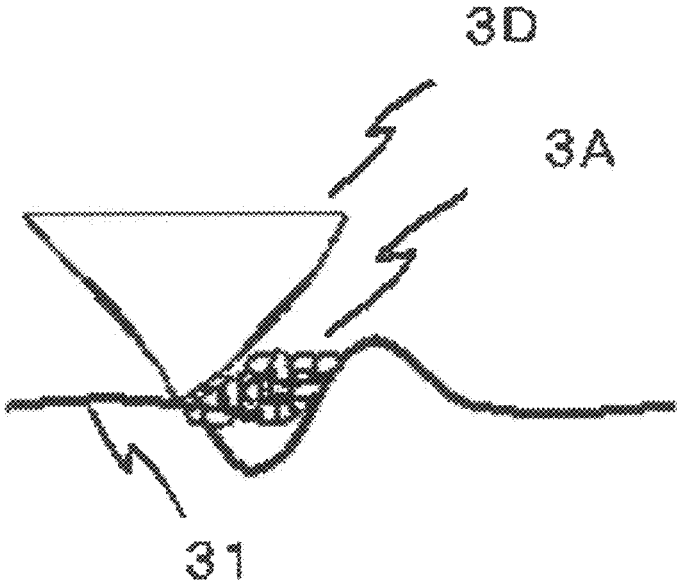
FIG. 14 is a drawing showing yet another example of poor applicability of a lubricant onto an electrophotographic photoconductor.
Figure 15:
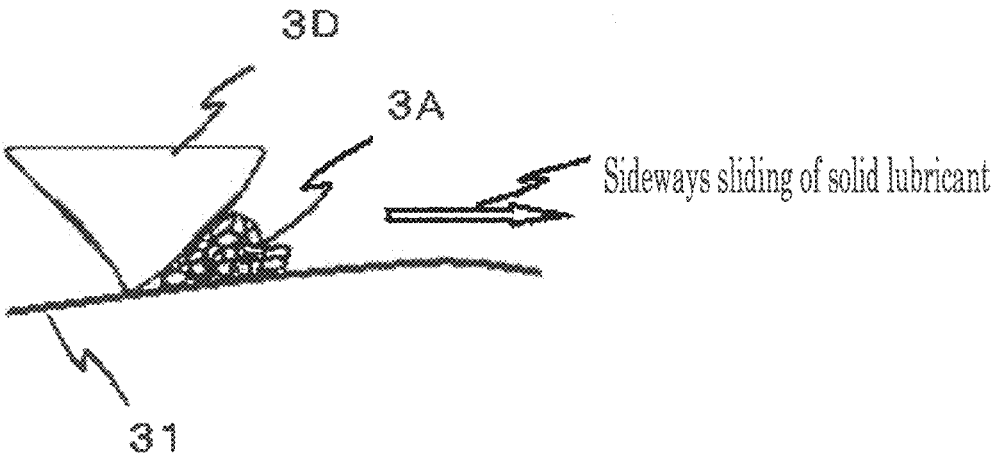
FIG. 15 is a schematic drawing showing a state in which an electrophotographic photoconductor's depressions and protrusions with a small height difference vary the linear pressure of an application blade.

When the depressions and the protrusions of the photoconductor surface do not have an appropriate period, an aggregate of the lubricant comes into point-contact with edges of the depressions and the protrusions as shown in FIG. 14 and thus the lubricant may easily come off the photoconductor surface, although the sideways sliding of the lubricant may be prevented by the depressions and the protrusions. Accordingly, the present inventors have considered that it is possible to enhance the quality of attachment of the lubricant by providing the photoconductor surface with gentle depressions and protrusions (as shown in FIG. 15) which enable the linear pressure of the application blade to increase or decrease appropriately such that the lubricant passes through the application blade or the application blade is pressed against the photoconductor surface to spread the lubricant over the photoconductor surface, and by further providing the photoconductor surface with appropriate depressions and protrusions with a great height difference which make it possible to prevent the sideways sliding of the lubricant.

The foregoing is an examination conducted in an attempt to enhance the quality of attachment of the lubricant onto the photoconductor surface. Further, the present invention is aimed at promoting circulation of the solid lubricant on the photoconductor by providing removability of the lubricant. The following explains removal of the solid lubricant.

Conventionally, means of performing surface treatment by providing cuts in a photoconductor surface have been disclosed. However, since the surface treatment is not intended for removal of a lubricant, application of the surface treatment without modification does not improve removability of a lubricant. The pitch of grooves formed by the surface treatment is 10 μm or less in many cases. When a photoconductor is continuously used in an electrophotographic process where a large number of members (including a cleaning blade) rub against the photoconductor, minute scratches with a pitch that is close to the above-mentioned pitch are formed in the photoconductor surface; as yet, there have been no findings which show that these scratches enhance removability of the lubricant.

With a filler present at the surface of an electrophotographic photoconductor, the surface can be provided with minute depressions and protrusions. When minute depressions and protrusions are provided as if on the floor in a bathroom, slipperiness-preventing effects can be obtained. In this case, drainage is not necessarily favorable, and thus groove as drainage paths are formed in many cases to obtain quick drying capability of the surface.

The present inventors have considered that formation of a pattern on the surface of the electrophotographic photoconductor in light of such findings makes it possible to enhance removability of the solid lubricant. As a result of examination in various ways, they have found that definition of the width, depth and direction of grooves in the surface of the electrophotographic photoconductor is also an important element.

Division of the surface of the electrophotographic photoconductor into appropriate small sections by the formation of the grooves makes it possible to change the attachment force and removability of the lubricant. Also, by forming the grooves in a direction which diagonally crosses a main scanning direction and a sub-scanning direction of the electrophotographic photoconductor, a smooth flow of the lubricant in the advancing direction of the grooves by the driving of the photoconductor is not hindered. When the grooves are formed in a direction parallel to the main scanning direction, vibration can be provided to members which rub against the photoconductor according to the period of the grooves, but the lubricant could remain at edges of the grooves. Parenthetically, by providing vibration to the members which rub against the photoconductor, it is possible to lessen stress. When the grooves are formed in a direction parallel to the sub-scanning direction, vibration cannot be provided to the members which rub against the photoconductor, and thus the lifetime of the apparatus could be shortened owing to the degradation of the members.

The present inventors have confirmed that an electrophotographic photoconductor with grooves formed in a direction which diagonally crosses the main scanning direction and the sub-scanning direction can enhance circulation of the lubricant due to the formation of the grooves, and thus completed the present invention.

The present invention provides (1) to (7) below.

(1) An electrophotographic photoconductor including: a conductive substrate; a photosensitive layer; and a surface layer having grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor.

(2) The electrophotographic photoconductor according to (1), wherein bottom portions of the grooves and areas separated from each other by the grooves contain a resin having a cross-linked structure with charge transporting properties.

(3) The electrophotographic photoconductor according to (1) or (2), wherein the surface layer contains an acrylic leveling agent.

(4) The electrophotographic photoconductor according to any one of (1) to (3), wherein the surface layer has an acrylate structural unit containing an acryloyloxy group, and a charge transporting structural unit.

(5) The electrophotographic photoconductor according to any one of (1) to (4), wherein bottom portions of the grooves and areas separated from each other by the grooves contain a metal oxide filler.

(6) A method for producing an electrophotographic photoconductor, including: forming a surface layer having grooves which do not intersect each other, by applying droplets from a droplet ejection head in accordance with an inkjet method, wherein the electrophotographic photoconductor is the electrophotographic photoconductor according to any one of (1) to (5).

(7) An image forming apparatus including: at least one image forming unit which includes an electrophotographic photoconductor and a lubricant applying unit, wherein the lubricant applying unit includes a unit configured to sweep off a lubricant with a roller brush and transfer the lubricant to a surface of the electrophotographic photoconductor, and also includes a blade with which the transferred lubricant is uniformly applied over the surface of the electrophotographic photoconductor, wherein the electrophotographic photoconductor is the electrophotographic photoconductor according to any one of (1) to (5).

In the present invention, the grooves are formed in the surface of the electrophotographic photoconductor, preferably in such a manner that the lubricant easily enters the grooves and that the paths where the lubricant flows are not hindered. Accordingly, it is appropriate that the grooves each have a width of 60 μm to 400 μm, more appropriately 60 μm to 100 μm. By adjusting the width of each groove to 400 μm or less, it is possible to greatly reduce cases where the lubricant adheres to the grooves. The limitation of the groove width is thought to improve circulation of the lubricant. By adjusting the groove width to 60 μm or more, it is possible to reduce cases where the grooves are clogged. From the viewpoint of the groove production, when the groove width is decreased, partially blocked grooves are formed in many cases, and thus there may be a deficiency of production uniformity.

The grooves are formed in a direction which diagonally crosses the main scanning direction and the sub-scanning direction of the electrophotographic photoconductor. The reason why the grooves are not formed in the form of a grid but diagonally formed is to allow the lubricant supplied in powder form to be present evenly in an efficient manner on the surface of the electrophotographic photoconductor with respect to the moving direction from the upstream side to the downstream side of the electrophotographic photoconductor and to make it easier to remove the lubricant appropriately. For example, in the case the lubricant is evenly applied by means of an application blade, formation of the grooves in such a manner as to be parallel to the moving direction (rotational direction) of the electrophotographic photoconductor makes it difficult for the blade to come into contact with the whole of the grooves and thus allows the lubricant to pass through the blade instead of evenly applying the lubricant. Meanwhile, formation of the grooves in such a manner as to be perpendicular to the moving direction (rotational direction) of the electrophotographic photoconductor allows the lubricant to remain at edges of the grooves and eventually causes a problem in which a degraded part of the lubricant cannot be removed and remains on the electrophotographic photoconductor.

Also, to enhance the circulation efficiency of the lubricant, the present invention is designed to enhance the attachment quality of the lubricant (when supplied onto the surface of the electrophotographic photoconductor), uniform spreadability of the lubricant, and removability of the lubricant (such that the lubricant is discharged to the outside of the system at appropriate times). In many cases, the lubricant is evenly applied using an application blade for spreading the lubricant. Also, in many cases, the lubricant is discharged using a cleaning blade. It is very important to stabilize the state of contact between each blade and the electrophotographic photoconductor. If a blade edge is pulled to a great extent or a cutaway part is formed in the edge, an initial purpose cannot be achieved. To stabilize this contact state, definition of the space between each groove and the depth of each groove is important. In addition, it is important to reduce variation of the depth of the grooves and provide uniform grooves in the surface of the electrophotographic photoconductor. In related art, in most cases, the groove depth is defined based upon an average value. When the groove depths have the same average value but there is variation in groove depth, some grooves function favorably but other grooves do not. In the present invention, to allow all the formed grooves to function favorably, the grooves each have a depth of 0.2 μm to 2 μm, and the standard deviation of the depths of the grooves is 1/10 or less of the average value of the depths of the grooves measured at any four places.

To form such grooves with a uniform depth, formation of a surface shape by an inkjet method is advantageous. The inkjet method makes it possible to fly ejected droplets accurately. Also, the inkjet method is very suitable for the groove formation because the ejecting operation of each nozzle can be controlled.

An appropriate ink is required to realize formation of a pattern on the surface of the electrophotographic photoconductor by the inkjet method. This means that it is necessary to adjust the volatility of an ink solvent, the viscosity and surface tension of the ink, and the solid content concentration of the ink. In view of these points, a resin material with a cross-linked structure is appropriate for the ink because it allows an ink component to be formed only of a low-molecular-weight monomer. Further, the surface obtained by the pattern formation is very advantageous because it is a resin with a cross-linked structure and is therefore strong.

When the inkjet method is used in forming grooves in the surface of the electrophotographic photoconductor, it is necessary to adjust the wettability of the base to which droplets ejected from a head are applied. For example, when the base surface to which the droplets are applied is formed of a material which does not easily dissolve, such as a cross-linked resin, and silicone oil remains, the droplets are repelled and thus independent dot shapes are obtained even if a pattern of linear shapes or surface shapes is intended to be formed. Used as a leveling agent, silicone oil is needed for uniform film formation. Meanwhile, since use of an acrylic leveling agent which is free of silicone oil makes it possible to obtain a favorable balance between the quality of a coating film over the base and the pattern formation by the inkjet method, it is easily possible to increase the accuracy of the pattern formation over the surface of the electrophotographic photoconductor.

When a resin with a cross-linked structure superior in abrasion resistance is used for the base, it possible to provide an electrophotographic photoconductor surface superior in abrasion resistance. Accordingly, sustenance of the surface shape is obtained. This is because, even if some chemical bonds contained in the resin film are broken owing to degradation of durability, abrasion can be prevented as long as other chemical bonds remain intact.

Among resins with cross-linked structures, an acrylic resin is greater in permittivity than a solid solution of polycarbonate and a charge transporting material, so that the acrylic resin has merit in that effects of the shape of depressions and protrusions on electrostatic properties are small.

Addition of a filler to the surface layer makes it possible to provide minute depressions and protrusions. Thus, it becomes easier to obtain an effect of enhancing the circulation efficiency of the lubricant. The provision of the filler makes it possible to form a layer that feels soft, which is effective as a means of enhancing the texture effect further. Also, the provision of the filler makes it possible to further improve abrasion resistance, which leads to a further advantage in terms of sustenance of the surface shape. It is desirable that the filler have a primary particle diameter of the order of a nanometer; use of alumina, tin oxide, titania, silica, ceria, etc. is favorable.

These fillers do not allow the surface of the electrophotographic photoconductor to be a thorny surface and thus can reduce damage done to members which rub against the electrophotographic photoconductor.

When a mechanism which sweeps off the lubricant with a brush and supplies the lubricant (which has been swept off) to the electrophotographic photoconductor surface with the brush is provided as a lubricant applying unit configured to apply the lubricant to the electrophotographic photoconductor surface, there is an advantage because it is possible not only to control the consumption of the lubricant with ease but also to supply the lubricant over the entire surface of the electrophotographic photoconductor. Further, besides the cleaning blade, provision of an application blade (which rubs against the electrophotographic photoconductor) on the downstream side of the brush and on the upstream side of the cleaning blade makes it possible to regulate the amount of the lubricant supplied to the electrophotographic photoconductor surface and promote uniform application of the lubricant. The brush and the application blade are effective means in adjusting the circulation of the lubricant.

(Electrophotographic Photoconductor)

Hereinafter, the electrophotographic photoconductor of the present invention will be specifically explained with reference to the drawings.

Figure 7:
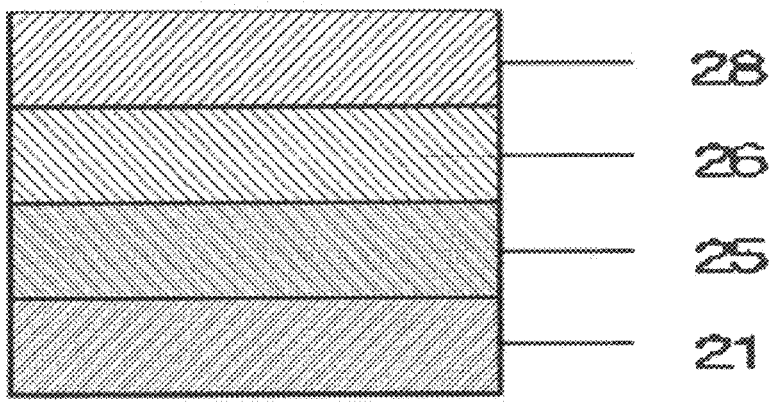
FIG. 7 is a cross-sectional view showing a layer structure of an electrophotographic photoconductor according to the present invention.

FIG. 7 is a cross-sectional view schematically showing an example of a layer structure of an electrophotographic photoconductor according to the present invention. A charge generating layer 25, a charge transporting layer 26 and a cross-linked surface layer 28 are provided over a conductive substrate 21.

Figure 8:
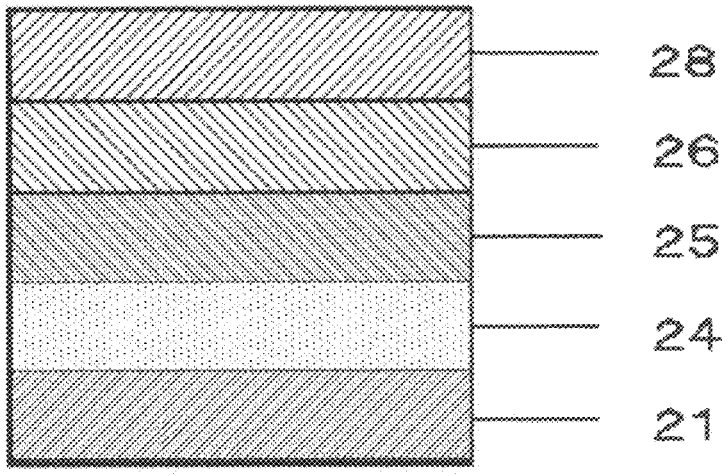
FIG. 8 is a cross-sectional view showing another layer structure of an electrophotographic photoconductor according to the present invention.

FIG. 8 is a cross-sectional view schematically showing an example of another layer structure of an electrophotographic photoconductor according to the present invention. An underlayer 24 is provided between a conductive substrate 21 and a charge generating layer 25, and a charge transporting layer 26 and a cross-linked surface layer 28 are provided over the charge generating layer 25.

<Conductive Substrate>

The conductive substrate 21 is a substrate exhibiting conductivity such that its volume resistance is $10^{10}\Omega$-cm or lower. For example, the substrate may be prepared by applying a metal such as aluminum, nickel, chromium, Nichrome, copper, silver, gold, platinum or iron, or a metal oxide such as tin oxide or indium oxide, for example by vapor deposition or sputtering, onto film-form or cylindrical plastic or paper, or using a plate of aluminum, aluminum alloy, nickel, stainless steel, etc. and making it into a crude tube by drawing ironing, impact ironing, extruded ironing, extruded drawing, cutting, etc. and then surface-treating the tube by cutting, super-finishing. polishing, etc.

<Underlayer>

In the electrophotographic photoconductor of the present invention, the underlayer can be provided between the conductive substrate and a photosensitive layer. The underlayer is provided for the purpose of improvement in adhesiveness, prevention of moire, improvement in coatability of layers formed thereon, prevention of injection of charge from the conductive substrate, and the like.

The underlayer is mainly composed of a resin. The photosensitive layer is generally applied over the underlayer, and so a thermosetting resin, which is sparingly soluble in organic solvent, is suitable as the resin for use in the underlayer. Most of polyurethane resins, melamine resins and alkyd-melamine resins are especially preferred because these satisfy the purposes described above. A coating material can be prepared by suitably diluting such a resin in a solvent such as tetrahydrofuran, cyclohexanone, dioxane, dichloroethane or butanone.

In addition, fine particles of metal or metal oxide may be added to the underlayer to adjust the conductivity and prevent moire. Titanium oxide is particularly preferably used.

The fine particles may be dispersed in a solvent such as tetrahydrofuran, cyclohexanone, dioxane, dichloroethane or butanone with a ball mill, an attritor or a sand mill to form a dispersion liquid, and the dispersion liquid may be mixed with a resin component to prepare a coating material.

The underlayer is formed by applying the coating material onto the conductive substrate by a dip coating method, a spray coating method, a bead coating method or the like and optionally curing the coating material by heating.

The thickness of the underlayer is preferably in the approximate range of 2 μm to 5 μm. When the electrophotographic photoconductor tends to have a high residual potential, the thickness thereof is preferably made to be less than 3 μm.

<Photosensitive Layer>

As the photosensitive layer of the electrophotographic photoconductor of the present invention, a multilayered photosensitive layer is suitable in which a charge generating layer and a charge transporting layer are formed in this order.

—Charge Generating Layer—

The charge generating layer refers to a part of the multi-layered photosensitive layer and has a function of generating charges by light exposure. This layer is mainly formed of a charge generating material that is among compounds contained therein. The charge generating layer may contain a binder resin, if necessary. Both inorganic material and organic material can be used as the charge generating material.

The inorganic material is not particularly limited, and those known in the art may be used. Specific examples of the inorganic material include crystal selenium, amorphous-selenium, selenium-tellurium, selenium-tellurium-halogen, selenium-arsenic compounds and amorphous silicon. With regard to the amorphous silicon, those in which a dangling bond is terminated with a hydrogen atom or a halogen atom, and those in which boron atoms, phosphorous atoms, etc. are doped are preferably used.

The organic material is not particularly limited, and those known in the art may be used. Specific examples of the organic material include metal phthalocyanines such as titanyl phthalocyanine, chlorogallium phthalocyanine, metal-free phthalocyanines, azulenium salt pigments, squaric acid methine pigments, symmetric or asymmetric azo pigments having a carbazole skeleton, symmetric or asymmetric azo pigments having a triphenylamine skeleton, symmetric or asymmetric azo pigments having a fluorenone skeleton, and perylene pigments. Among these, metal phthalocyanines, symmetric or asymmetric azo pigments having a fluorenone skeleton, symmetric or asymmetric azo pigments having a triphenylamine skeleton, and perylene pigments are preferably used in the present invention, since all of these have very high quantum efficiency in relation to charge generation. These charge generating materials may be used individually or in combination.

The binder resin optionally used in the charge generating layer is not particularly limited and may be suitably selected according to the intended use. Specific examples thereof include polyamides, polyurethanes, epoxy resins, polyketones, polycarbonates, polyarylates, silicone resins, acrylic resins, polyvinyl butyral, polyvinylformal, polyvinyl ketones, polystyrenes, poly-N-vinylcarbazole and polyacrylamides. In addition, polymeric charge transporting materials, which are described later, can also be used. Among these, polyvinyl butyral is most frequently used and useful. These binder resins can be used individually or in combination.

Methods of forming the charge generating layer are broadly divided into a vacuum thin-film forming method, and a casting method using a dispersion solution.

Specific examples of the vacuum thin-film forming method include, but are not limited to, a vacuum evaporation method, a glow discharge decomposition method, an ion plating method, a sputtering method, a reactive sputtering method and a chemical vapor deposition (CVD) method. Charge generating layers can be favorably formed by these methods, using the above-mentioned inorganic material(s) or organic material(s).

To provide the charge generating layer by the casting method, the above-mentioned inorganic or organic charge generating material(s) is/are dispersed (if necessary with a binder resin) in a solvent such as tetrahydrofuran, cyclohexanone, dioxane, dichloroethane or butanone, using a ball mill, an attritor, a sand mill, etc.; thereafter, the dispersion liquid is suitably diluted and applied so as to form the charge generating layer. Among examples of the solvent, methyl ethyl ketone, tetrahydrofuran and cyclohexanone are preferable to chlorobenzene, dichloromethane, toluene and xylene in that the extent of an environmental load is small. The diluted dispersion liquid can be applied by a dip coating method, a spray coating method, a bead coating method, etc.

The thickness of the charge generating layer thusly provided is preferably in the approximate range of 0.01 μm to 5 μm.

In the case where a reduction in residual potential and an increase in sensitivity are required, an increase in the thickness of the charge generating layer often makes it possible to improve these properties. However, the chargeability may often degrade in terms of maintainability of the charge and formation of space charge. In view of a favorable balance between these points, the thickness of the charge generating layer is more preferably in the range of 0.05 μm to 2 μm.

Additionally, if necessary, a low-molecular-weight compound such as an anti-oxidant, a plasticizer, a lubricant, an ultraviolet absorber, etc. and a leveling agent may be added into the charge generating layer. These compounds may be used individually or in combination. However, when the low-molecular-weight compound(s) and the leveling agent are used in combination, the sensitivity of the charge generating layer often degrades. Therefore, the amount of the low-molecular-weight compound(s) is generally in the approximate range of 0.1 phr to 20 phr, preferably 0.1 phr to 10 phr, and the amount of the leveling agent is preferably in the approximate range of 0.001 phr to 0.1 phr.

—Charge Transporting Layer—

The charge transporting layer refers to a part of the multi-layered photosensitive layer and has a function of injecting and transporting the charges generated by the charge generating layer and neutralizing the surface charge of the electrophotographic photoconductor generated by charging. The main components of the charge transporting layer are a charge transporting component and a binder component which binds the charge transporting component.

Examples of materials usable as the charge transporting material include low-molecular-weight electron transporting materials, hole transporting materials and high-molecular-weight charge transporting materials.

Specific examples of the electron transporting materials include, but are not limited to, electron accepting materials such as asymmetric diphenoquinone derivatives, fluorenone derivatives and naphthalimide derivatives. These electron transporting materials may be used individually or in combination.

The hole transporting materials are preferably electron donating materials. Specific examples of the hole transporting materials include, but are not limited to, oxazole derivatives, oxadiazole derivatives, imidazole derivatives, triphenylamine derivatives, butadiene derivatives, 9-(p-diethylaminostyryl anthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives and thiophene derivatives. These hole transporting materials may be used individually or in combination.

Additionally, the following high-molecular-weight charge transporting materials can, for example, be used as well: polymers having a carbazole ring, such as poly-N-vinylcarbazole; polymers having a hydrazone structure, mentioned as examples in JP-A No. 57-78402, etc.; polysilylene polymers mentioned as examples in JP-A No. 63-285552, etc.; and aromatic polycarbonates represented by the general chemical formulae (1) to (6) in JP-A No. 2001-330973. These high-molecular-weight charge transporting materials may be used individually or in combination. In particular, the compounds mentioned as examples in JP-A No. 2001-330973 are useful because they have favorable electrostatic properties.

When the cross-linked surface layer is laid over the charge transporting layer, any of the high-molecular-weight charge transporting materials allows a smaller amount of component(s) of the charge transporting layer to ooze to the cross-linked surface layer than low-molecular-weight charge transporting materials. Therefore, any of the high-molecular-weight charge transporting materials is suitable for preventing curing defects in the cross-linked surface layer. Furthermore, since the increase in the molecular weight of the charge transporting material yields superior heat resistance, the extent of degradation of the charge transporting layer caused by the curing heat generated when the cross-linked surface layer is formed is small, which is advantageous.

Specific examples of polymers usable as the binder component of the charge transporting layer include, but are not limited to, thermoplastic resins or thermosetting resins, such as polystyrenes, polyesters, polyvinyls, polyarylates, polycarbonates, acrylic resins, silicone resins, fluorine resins, epoxy resins, melamine resins, urethane resins, phenol resins and alkyd resins. When any of the polystyrenes, the polyesters, the polyarylates and the polycarbonates among these is used as the binder component of the charge transporting layer, favorable charge mobility is exhibited in many cases, which is advantageous. In addition, since the cross-linked surface layer is preferably laid over the charge transporting layer, the charge transporting layer is not required to have the mechanical strength required for a conventional charge transporting layer. Therefore, a material such as polystyrene, which is highly transparent but somewhat low in mechanical strength and thus which is difficult to apply to a binder component in related art, can be effectively used as the binder component of the charge transporting layer.

These polymers can be used individually or in combination. In addition, these polymers may be copolymers which are each composed of two or more raw material monomers therefor, and further, may be each copolymerized with charge transporting material(s).

When an electrically inactive polymer is used to improve the quality of the charge transporting layer, use of the following is effective: polyesters of Cardo polymer type having a bulky skeleton such as fluorine, polyesters such as polyethylene terephthalate and polyethylene naphthalate, polycarbonates which are each produced by alkyl-substituting the 3,3' site of a phenol component in a polycarbonate of bisphenol type such as C-type polycarbonate; polycarbonates which are each produced by substituting a geminal methyl group of bisphenol A in a polycarbonate with a long-chain alkyl group having two or more carbon atoms; polycarbonates having a biphenyl or biphenyl ether skeleton; polycaprolactone; polycarbonates having a long-chain alkyl skeleton such as polycaprolactone (mentioned, for example, in JP-A No. 07-292095); acrylic resins; polystyrenes; hydrogenated butadiene; and so forth.

The electrically inactive polymer refers to a polymer including no chemical structure having photoconductivity such as a triarylamine structure. When any of these resins is used as an additive in combination with a binder resin, the amount thereof added is preferably 50% by mass or less based on the total solid content of the charge transporting layer due to a constraint of optical decay sensitivity.

When a low-molecular-weight charge transporting material is used, the amount thereof is generally in the approximate range of 40 phr to 200 phr, preferably 70 phr to 100 phr. When any of the high-molecular-weight charge transporting materials is used, it is desirable to use a material produced by copolymerization of a resin component and a charge transporting component, with the amount of the resin component being in the approximate range of 0 parts by mass to 200 parts by mass, preferably 80 parts by mass to 150 parts by mass, per 100 parts by mass of the charge transporting component.

In the case where the charge transporting layer contains at least two types of charge transporting materials, it is preferred that the difference in ionization potential between these charge transporting materials be small. Specifically, by making the difference in ionization potential equal to or smaller than 0.10 eV, one charge transporting material can be prevented from being a charge trap for the other charge transporting material(s).

This relationship concerning ionization potential is applicable to the relationship between the charge transporting material contained in the charge transporting layer and the after-mentioned curable charge transporting material; that is, the difference in ionization potential between these is also preferably 0.10 eV or smaller. The ionization potential of the charge transporting material for use in the present invention is measured by a conventional method using an air atmosphere type ultraviolet photoelectron analyzer (AC-1, manufactured by Riken Keiki Co., Ltd.).

To improve the sensitivity, the amount of the charge transporting component is preferably 70 phr or more. Also, monomers or dimers of α-phenylstilbene compounds, benzidine compounds and butadiene compounds, and high-molecular-weight charge transporting materials having the foregoing in the main chain or a side chain are useful because these compounds tend to have high charge mobility.

The charge transporting layer is formed by dissolving or dispersing, in a certain solvent, a mixture or a copolymer mainly composed of the charge transporting component and the binder component so as to prepare a coating material for the charge transporting layer, and then applying and drying this coating material. Examples of employable coating methods include a dip coating method, a spray coating method, a ring coating method, a roll coating method, a gravure coating method, a nozzle coating method and a screen printing method.

Specific examples of dispersion solvents usable in preparing the coating material for the charge transporting layer include, but are not limited to, ketones such as methyl ethyl ketone, acetone, methyl isobutyl ketone and cyclohexanone; ethers such as dioxane, tetrahydrofuran and ethylcellosolve; aromatic compounds such as toluene and xylene; halogens such as chlorobenzene and dichloromethane; and esters such as ethyl acetate and butyl acetate. Among these, methyl ethyl ketone, tetrahydrofuran and cyclohexanone are preferable to chlorobenzene, dichloromethane, toluene and xylene in that the extent of an environmental load is small. These solvents may be used individually or in combination.

Since the cross-linked surface layer is generally laid over the charge transporting layer, the thickness of the charge transporting layer can be determined without considering an increase in the thickness that allows for scrapes of the layer caused in practical use. The thickness of the charge transporting layer is preferably in the approximate range of 10 μm to 40 μm, more preferably 15 μm to 30 μm, to secure the required sensitivity and chargeability.

Additionally, if necessary, a low-molecular-weight compound such as an anti-oxidant, a plasticizer, a lubricant, an ultraviolet absorber, etc. and a leveling agent may be added into the charge transporting layer. These compounds may be used individually or in combination. However, when the low-molecular-weight compound(s) and the leveling agent are used in combination, the sensitivity of the charge transporting layer often degrades. Therefore, the amount of the low-molecular-weight compound(s) is generally in the approximate range of 0.1 phr to 20 phr, preferably 0.1 phr to 10 phr, and the amount of the leveling agent is preferably in the approximate range of 0.001 phr to 0.1 phr.

As the surface layer, a cross-linked surface layer is preferable.

The cross-linked surface layer refers to a protective layer formed over the electrophotographic photoconductor. Regarding this protective layer, a coating material is applied, then a film of a resin with a cross-linked structure is formed by polymerization reaction of a radical polymerizable material component. Since the resin film has a cross-linked structure, the surface layer has the greatest abrasion resistance among the layers of the electrophotographic photoconductor. Also, in the case where the surface layer contains a cross-linked charge transporting structural unit, it exhibits charge transporting properties similar to those of the charge transporting layer.

Regarding the electrophotographic photoconductor of the present invention, the following points are important: the surface layer has grooves which do not intersect each other; the grooves each have a width of 60 μm to 100 μm and a depth of 0.2 μm to 2 μm; the standard deviation of the depths of the grooves is 1/10 or less of the average value of the depths of the grooves measured at any four places; and the grooves are formed in a direction which diagonally crosses the main scanning direction and the sub-scanning direction of the electrophotographic photoconductor. As a method of performing treatment such that the foregoing specific shape is obtained, an inkjet method is effective.

Also, the surface layer preferably contains an acrylic leveling agent. When the surface layer contains the acrylic leveling agent, it is possible to obtain a favorable balance between the coating film quality of the base and the pattern formed by the inkjet method, and thus to easily improve the accuracy of the pattern formation over the surface of the electrophotographic photoconductor.

Also, the surface layer preferably has an acrylate structural unit containing an acryloyloxy group, and a charge transporting structural unit.

—Radical Polymerizable Material Component—

Examples of the radical polymerizable material component include acryloyloxy group-containing acrylates.

In the present invention, it is preferable to use trimethylolpropane triacrylate for the electrophotographic photoconductor surface, for the purpose of preventing the flow of images, which stems from the use of tin oxide fine particles. Besides, the use of trimethylolpropane is favorable in that the abrasion resistance of the photoconductor surface can be enhanced.

As a trivalent or higher binder component, caprolactone-modified dipentaerythritol hexaacrylate or dipentaerythritol hexaacrylate is preferable. When it is used, the abrasion resistance and strength of the cross-linked film itself can be increased in many cases.

As a trivalent or higher radical polymerizable monomer without a charge transporting structure, trimethylolpropane triacrylate, caprolactone-modified dipentaerythritol hexaacrylate or dipentaerythritol hexaacrylate is preferred.

Specific examples thereof include those manufactured by pharmaceutical makers such as Tokyo Chemical Industry Co., Ltd., and KAYARD DPCA Series and DPHA Series manufactured by Nippon Kayaku Co., Ltd.

Also, in order to promote curing and secure stabilization, an initiator such as IRGACURE 184 (manufactured by Ciba Specialty Chemicals plc) may be added in an amount of 5% by mass to 10% by mass with respect to the total solid content.

Examples of cross-linkable charge transporting materials include chain polymerization compounds including an acryloyloxy group and/or a styrene group, and sequential polymerization compounds including a hydroxyl group, an alkoxysilyl group, and/or an isocyanate group. Compounds each having a charge transporting structure and one or more (meth) acryloyloxy groups can be favorably used.

Also, the cross-linked surface layer may have a structure provided also with a monomer or oligomer which does not have a charge transporting structure but has one or more (meth)acryloyloxy groups.

For example, the cross-linked surface layer can be produced by adding such a compound at least into a coating liquid, applying the coating liquid so as to form a layer, and cross-linking and curing the layer by application of energy based upon heat, light, or radiant rays such as electronic rays or γ rays.

Examples of the compounds each having a charge transporting structure and one or more (meth)acryloyloxy groups include the charge transporting compounds represented by General Formula 1 below.

General Formula 1

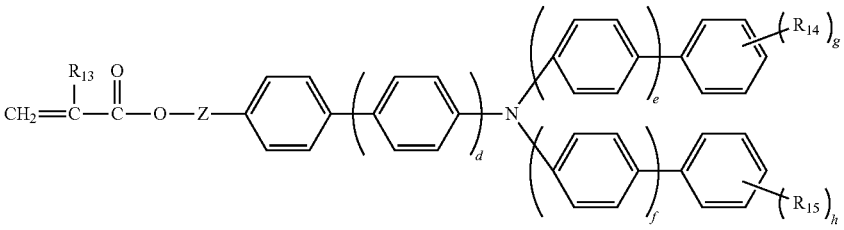

In General Formula 1, the letters d, e and f each denote an integer of 0 or 1. $R_{13}$ denotes a hydrogen atom or a methyl group. $R_{14}$ and $R_{15}$ each denote a C1-C6 alkyl group; when $R_{14}$ and $R_{15}$ each denote an alkyl group containing a plurality of carbon atoms, they may be different alkyl groups. The letters g and h each denote an integer of 0 to 3. The letter Z denotes any one of a single bond, a methylene group, an ethylene group, and the groups shown below.

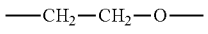

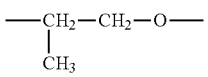

-continued
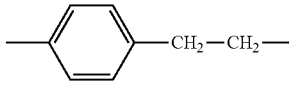
Specific examples of charge-transporting compounds represented by General Formula 1 above include the compounds shown below.
No. 1
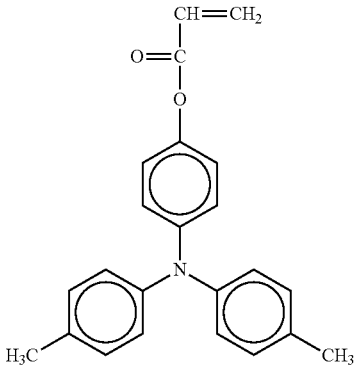
No. 2
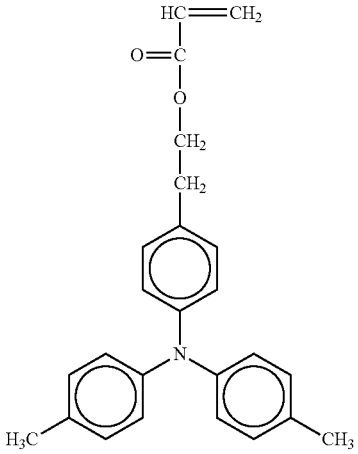
No. 3
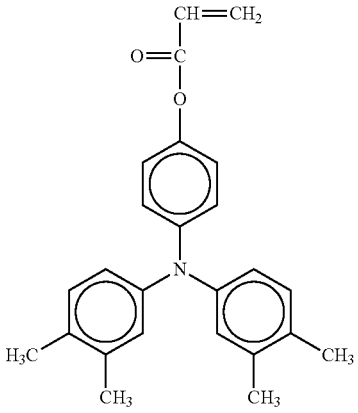
-continued
No. 4
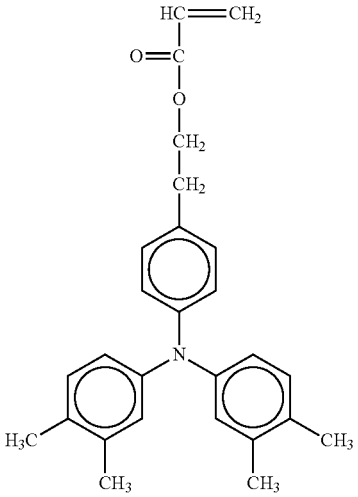
No. 5
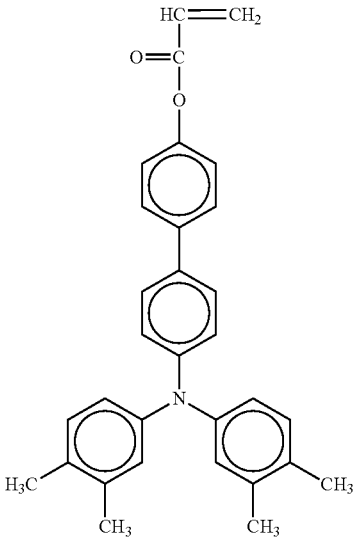
No. 6
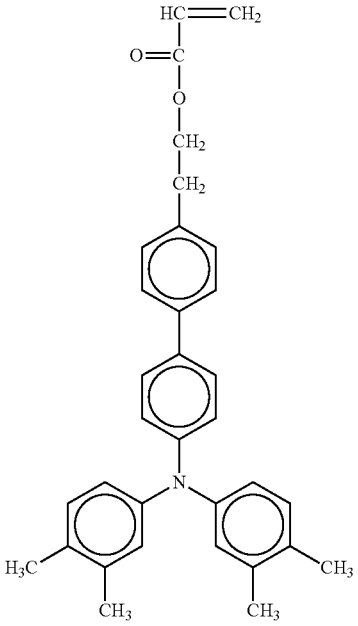

-continued
No. 7
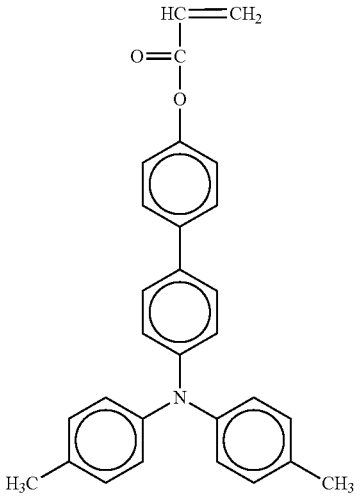
No. 8
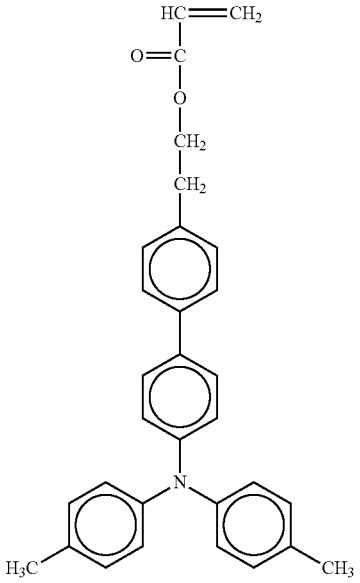
-continued
No. 9
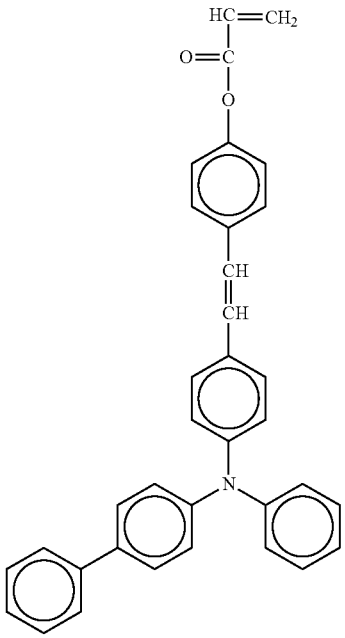
No. 10
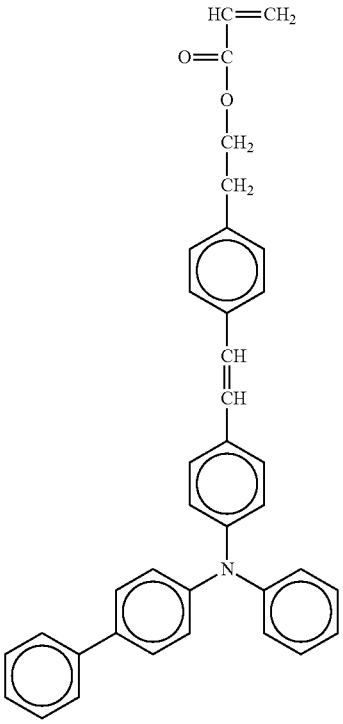

-continued
No. 11
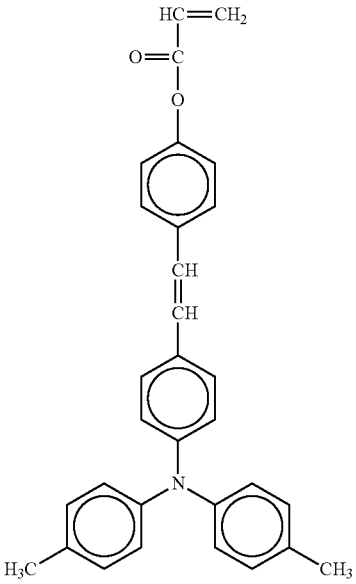
No. 12
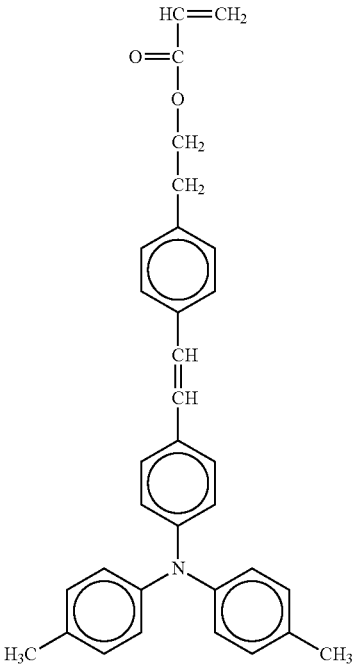
-continued
No. 13
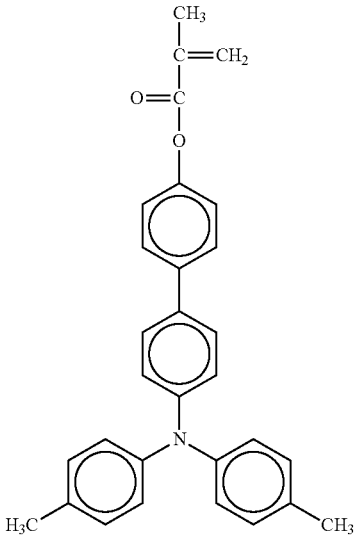
No. 14
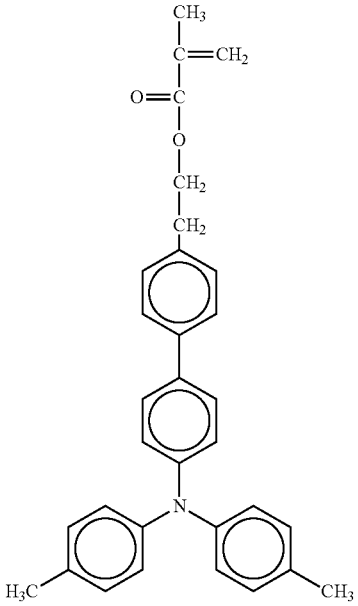

-continued
No. 15
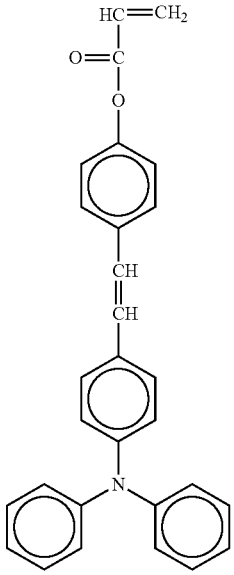
No. 16
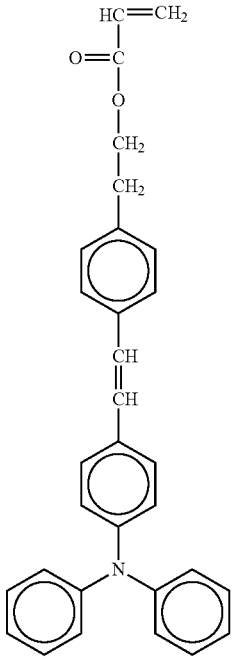
-continued
No. 17
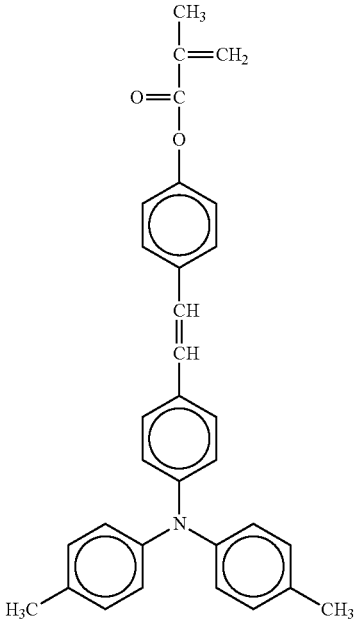
No. 18
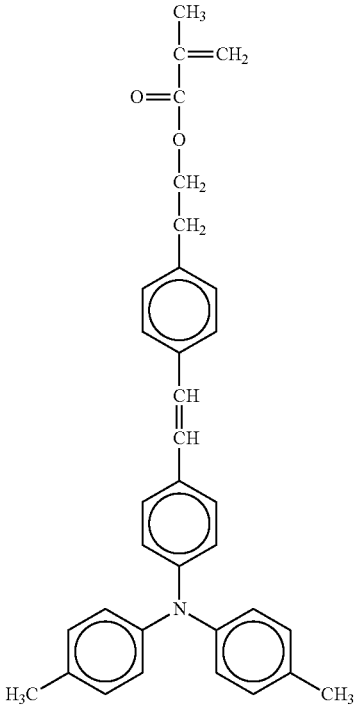

-continued
No. 19
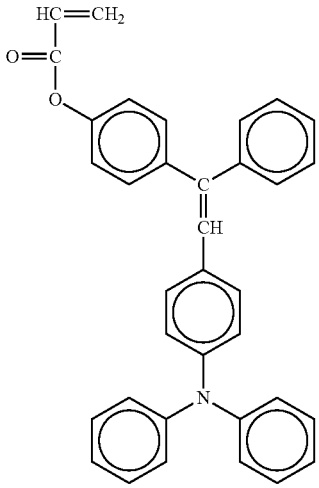
No. 20
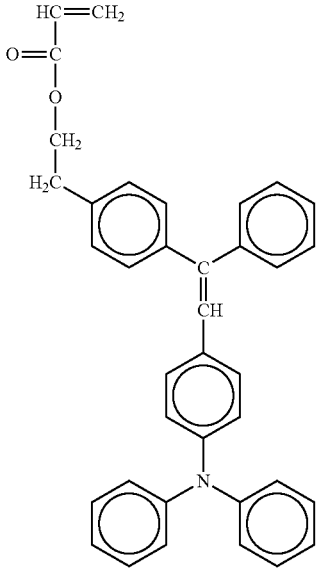
No. 21
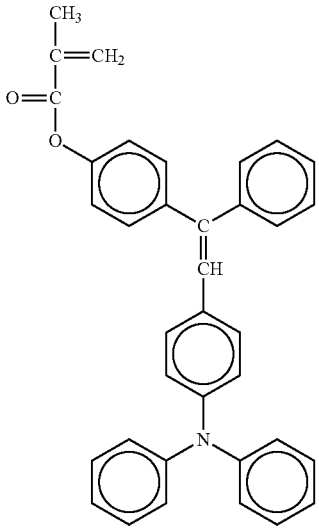
-continued
No. 22
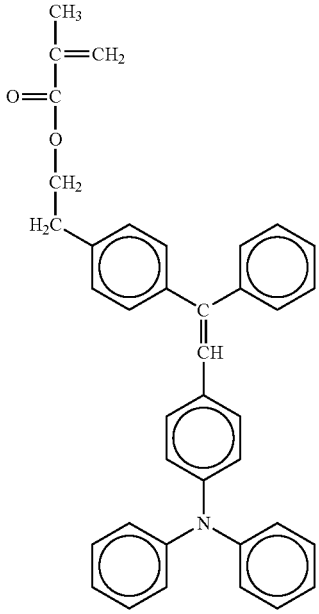
No. 23
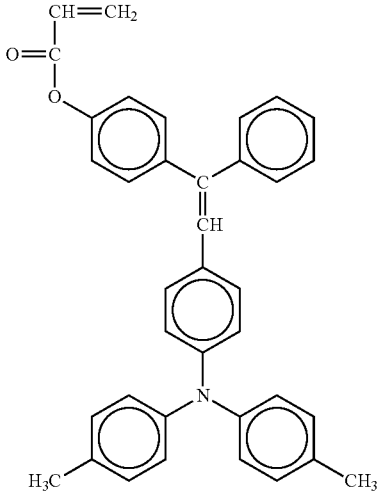

-continued

No. 24

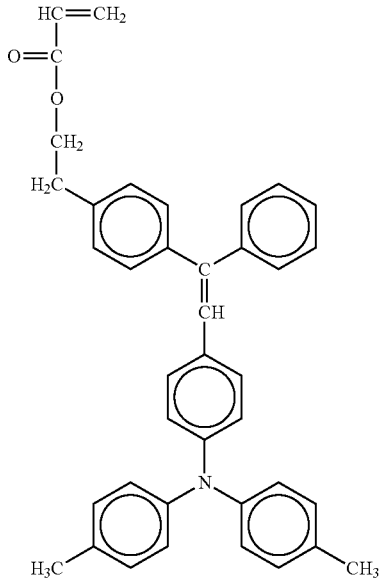

No. 25

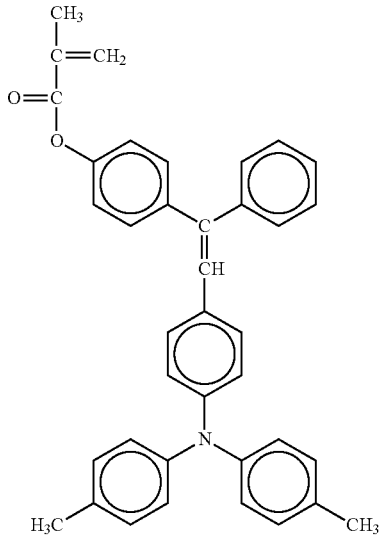

-continued

No. 26

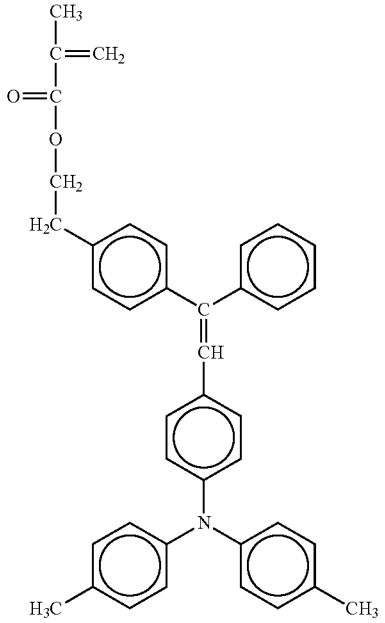

The cross-linked surface layer can be formed, for example, by applying a surface layer coating material which contains the above-mentioned radical polymerizable material component and a solvent, etc.

The solvent used for preparing the cross-linked surface layer coating material preferably dissolves the monomers sufficiently. Examples thereof include ether solvents, aromatic solvents, halogen-containing solvents, ester solvents, cellosolves (e.g., ethoxyethanol) and propylene glycols (e.g., 1-methoxy-2-propanol). Among these, methyl ethyl ketone, tetrahydrofuran, cyclohexanone and 1-methoxy-2-propanol are preferable to chlorobenzene, dichloromethane, toluene and xylene in that the extent of an environmental load is small. These solvents may be used individually or in combination.

Examples of methods of applying the cross-linked surface layer coating material include a dip coating method, a spray coating method, a ring coating method, a roll coating method, a gravure coating method, a nozzle coating method and a screen printing method. In many cases, the coating material does not have a long pot life; thus, a means of coating which enables required coating with a small amount of coating material is advantageous from the viewpoints of environmental protection and cost reduction. Among the above methods, a spray coating method and a ring coating method are preferred. In particular, in order to provide the specific shape according to the present invention, use of an inkjet method is favorable.

In forming the cross-linked surface layer, a UV irradiation light source may be used such as a high-pressure mercury lamp or metal halide lamp which has an emission wavelength mainly in the UV region. Also, a light source emitting visible light may be used depending on the wavelengths of light absorbed by the radical polymerizable compound and a photopolymerization initiator. The irradiation light intensity is preferably in the range of 50 mW/cm$^2$ to 1,000 mW/cm$^2$. When the irradiation light intensity is less than 50 mW/cm$^2$, curing reaction may take a lot of time for its completion. When the irradiation light intensity is more than 1,000 mW/cm$^2$, curing reaction does not proceed in a uniform manner, causing localized wrinkles on the cross-linked surface layer and/or generating many unreacted residues and reaction termination ends. Further, cross-linking reaction proceeds excessively rapidly, and thus the internal stress of the formed cross-linked surface layer becomes great, causing cracking and film peeling.

If necessary, the cross-linked surface layer may contain, for example, the low-molecular-weight compound(s) (such as an anti-oxidant, a plasticizer, a lubricant, an ultraviolet absorber, etc.) and the leveling agent that are described above in relation to the charge generating layer, and any of the polymers described above in relation to the charge transporting layer. These compounds may be used individually or in combination. However, when the low-molecular-weight compound(s) and the leveling agent are used in combination, the sensitivity of the cross-linked surface layer often degrades. Therefore, the amount of the low-molecular-weight compound(s) is generally in the approximate range of 0.1% by mass to 20% by mass, preferably 0.1% by mass to 10% by mass, and the amount of the leveling agent is preferably in the approximate range of 0.1% by mass to 5% by mass.

The thickness of the cross-linked surface layer is preferably in the approximate range of 3 μm to 15 μm. The lower limit of the thickness is determined in consideration of cost-effectiveness regarding film formation. The upper limit of the thickness is determined in consideration of electrostatic properties (e.g., charging stability and optical decay sensitivity) and the uniformity of film quality.

(Formation of Diagonal Grooves)

Regarding the electrophotographic photoconductor, the following points are important: the surface layer has grooves which do not intersect each other; the grooves each have a width of 60 μm to 100 μm and a depth of 0.2 μm to 2 μm; the standard deviation of the depths of the grooves is 1/10 or less of the average value of the depths of the grooves measured at any four places; and the grooves are formed in a direction which diagonally crosses the main scanning direction and the sub-scanning direction of the electrophotographic photoconductor.

Figure 16:
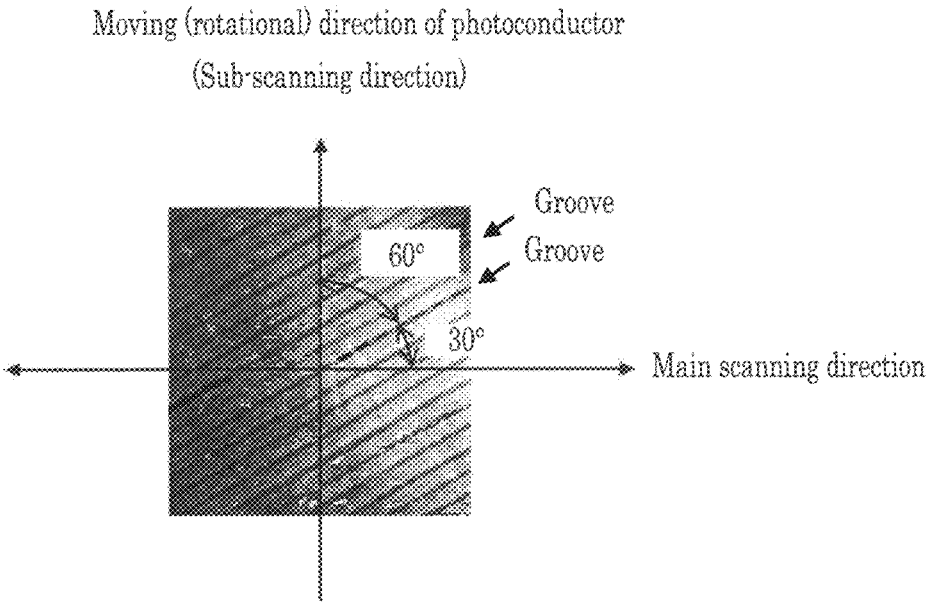
FIG. 16 is a drawing exemplarily showing how grooves in the surface of an electrophotographic photoconductor are angled.

In the present invention, the direction in which the electrophotographic photoconductor moves or rotates is defined as the sub-scanning direction, for the sake of simplicity. The direction perpendicular to the sub-scanning direction is defined as the main scanning direction, and the direction of the grooves is defined based upon the sub-scanning direction and the main scanning direction. An example of the foregoing relationship is shown in FIG. 16. The angle formed between each diagonal groove and the sub-scanning direction is preferably determined such that the amount of the lubricant supplied onto the electrophotographic photoconductor and the discharge efficiency of the lubricant are increased according to the linear velocity of the electrophotographic photoconductor and process conditions. It is important that the grooves do not run parallel to the main scanning direction or the sub-scanning direction. Because if they run parallel with the main scanning direction or the sub-scanning direction, adhesion of the lubricant is caused. Also, in the present invention, since the grooves do not intersect each other, there is little damage done to the members which rub against the electrophotographic photoconductor. As a method for forming such a specific pattern on the surface layer, an inkjet method is very favorable. When the inkjet method is used, it is necessary to control the base surface in such a manner as to prevent droplets (ejected from an inkjet head) from being repelled. Especially when a silicone oil (generally used as a leveling agent) is present on the base, it may be difficult to form a desired film. Meanwhile, the acrylic leveling agent yields recoating capability. Preferred examples of the acrylic leveling agent include BYK-350, BYK-355, BYK-356, BYK-358N and BYK-361N (manufactured by BYK-Chemie).

Bottom portions of the grooves and areas separated from each other by the grooves preferably contain a resin having a cross-linked structure with charge transporting properties.

The bottom portions of the grooves and the areas separated from each other by the grooves preferably contain a metal oxide filler.

(Image Forming Apparatus)

With reference to the drawings, the following explains an image forming apparatus used in the present invention. The image forming apparatus of the present invention has a lubricant applying unit configured to supply the after-mentioned lubricant to the surface of an electrophotographic photoconductor. For the sake of simplicity, this unit will be explained after the image forming apparatus has been explained.

Figure 1:
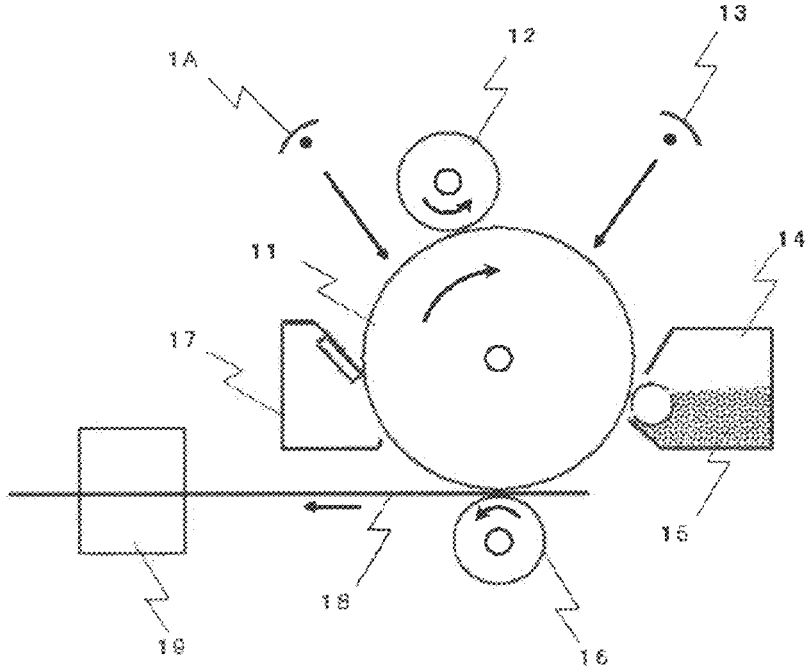
FIG. 1 is a schematic cross-sectional view showing an example of an image forming apparatus according to the present invention.

FIG. 1 is an explanatory schematic view of the image forming apparatus of the present invention. The present invention encompasses the after-mentioned modification examples.

In FIG. 1, an electrophotographic photoconductor 11 is an electrophotographic photoconductor having a cross-linked surface layer. The electrophotographic photoconductor 11 is in the form of a drum. Alternatively, the photoconductor 11 may be in the form of a sheet or endless belt.

A charging unit 12 may be any of known chargers such as a corotron charger, a scorotron charger, a solid state charger and a charging roller. It is preferred, from the viewpoint of reduction in power consumption, that the charging unit be placed so as to be in contact with or close to the electrophotographic photoconductor. In order to prevent the charging unit from being smeared, the charging unit is particularly preferably placed close to the electrophotographic photoconductor such that the charging unit surface is suitably spaced from the electrophotographic photoconductor surface. Generally, a transfer unit 16 may be any of the above chargers and the like. Nevertheless, it is effective to use, as the transfer unit, a combination of a transfer charger and a separation charger.

A light source used in an exposing unit 13, a charge-eliminating unit 1A, etc. may be a light-emitting device such as a fluorescent lamp, a tungsten lamp, a halogen lamp, a mercury lamp, a sodium lamp, a light-emitting diode (LED), a laser diode (LD) or an electroluminescence (EL) lamp. Also, to apply light in a desired wavelength region exclusively, a filter may be used such as a sharp-cut filter, a band-pass filter, a near-infrared cut filter, a dichroic filter, an interference filter or a color temperature conversion filter.

A toner 15 developed on the electrophotographic photoconductor by a developing unit 14 is transferred onto a printing medium 18 such as printing paper or an OHP slide. It is not that all of the toner is transferred but that some of the toner remains on the electrophotographic photoconductor. Such residual toner is removed from the electrophotographic photoconductor by a cleaning unit 17. The cleaning unit may, for example, be a rubber cleaning blade or a brush such as a fur brush or mag-fur brush.

The toner transferred onto the printing medium 18 is fixed by a fixing unit 19.

When the electophotographic photoconductor is positively (negatively) charged and then subjected to imagewise exposure, a positive (negative) latent electrostatic image is formed on the electophotographic photoconductor surface. When the positive (negative) latent electrostatic image is developed with a negatively (positively) charged toner (charge-detecting fine particles), a positive image is obtained, whereas when the positive (negative) latent electrostatic image is developed with a positively (negatively) charged toner, a negative image is obtained. The developing unit and the charge-eliminating unit may employ respective methods known in the art.

Figure 2:
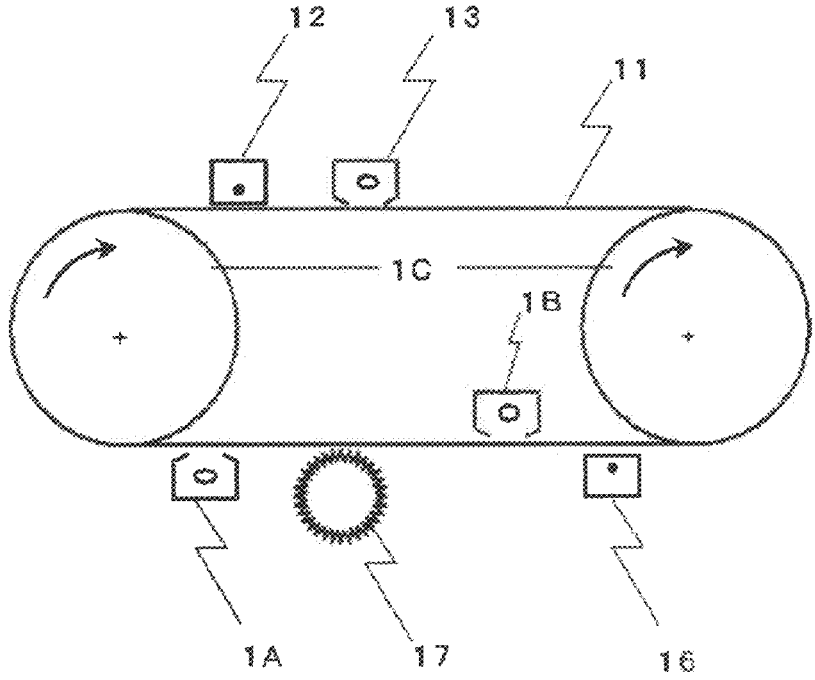
FIG. 2 is a schematic cross-sectional view showing another example of an image forming apparatus according to the present invention.

FIG. 2 shows another example of an image forming apparatus according to the present invention. In FIG. 2, an electrophotographic photoconductor 11 is an electrophotographic photoconductor having a cross-linked surface layer. The electrophotographic photoconductor 11 is in the form of a belt. Alternatively, the electrophotographic photoconductor 11 may be in the form of a drum, sheet or endless belt. While the electrophotographic photoconductor 11 is being driven by drive units 1C, there is a repeated process carried out, which includes charging by a charging unit 12, imagewise exposure by an exposing unit 13, development by a developing device (not shown), transfer by a transfer unit 16, pre-cleaning exposure by a pre-cleaning exposing unit 1B, cleaning by a cleaning unit 17, and charge elimination by a charge-eliminating unit 1A. In the apparatus shown in FIG. 2, light irradiation for pre-cleaning exposure is performed from the substrate side of the photoconductor (in this case, the substrate is translucent).

The above-mentioned electrophotographic process is an exemplary embodiment of the present invention; note that other embodiments can be employed as well. For example, although pre-cleaning exposure is performed from the substrate side in FIG. 2, this may be performed from the photosensitive layer side. Also, light irradiation for imagewise exposure and charge elimination may be performed from the substrate side. Further, although only the imagewise exposure, the pre-cleaning exposure and the charge-eliminating exposure are shown as a light irradiation step in FIG. 2, other additional light irradiation steps (such as pre-transfer exposure, pre-exposure related to imagewise exposure, etc.) known in the art may also be provided to irradiate the electrophotographic photoconductor with light.

Figure 3:
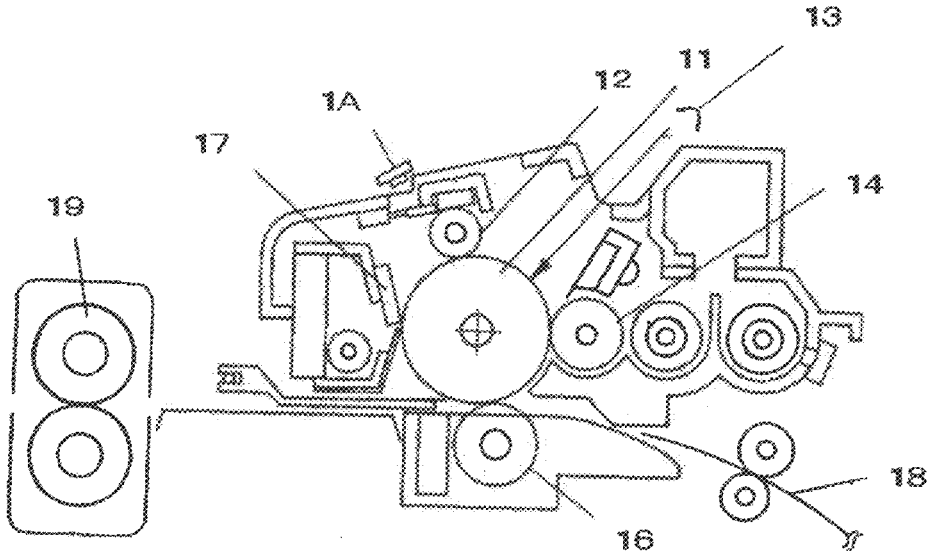
FIG. 3 is a schematic cross-sectional view showing yet another example of an image forming apparatus according to the present invention.

The above-mentioned image forming units may be fixed in a copier, facsimile or printer; alternatively, they may be installed therein in the form of a process cartridge. There are many examples of forms of the process cartridge. Typical examples thereof include the form of the process cartridge shown in FIG. 3. An electrophotographic photoconductor 11 is in the form of a drum. Alternatively, the electrophotographic photoconductor 11 may be in the form of a sheet or endless belt. The process cartridge shown in FIG. 3 includes the electrophotographic photoconductor 11, a charging unit 12, an exposing unit 13, a developing unit 14, a transfer unit 16, a cleaning unit 17, a fixing unit 19 and a charge-eliminating unit 1A. The reference numeral 18 denotes a printing medium.

Figure 4:
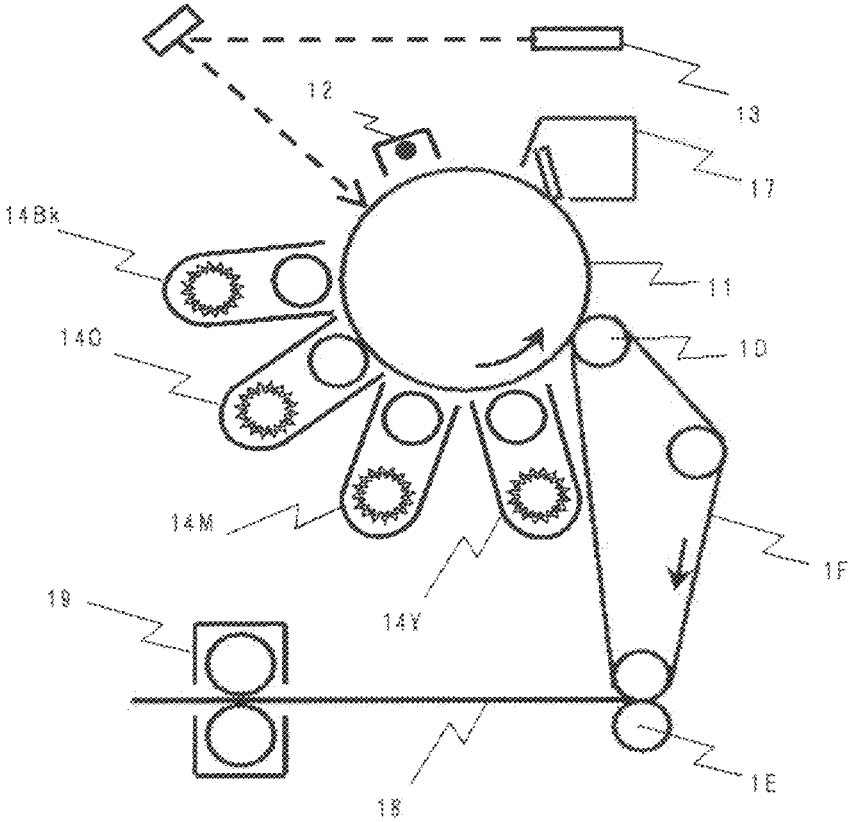
FIG. 4 is a schematic cross-sectional view showing yet another example of an image forming apparatus according to the present invention.

FIG. 4 shows yet another image forming apparatus according to the present invention. In this image forming apparatus, around an electrophotographic photoconductor 11 are sequentially provided a charging unit 12, an exposing unit 13, a developing unit 14Bk for black (Bk) toner, a developing unit 14C for cyan (C) toner, a developing unit 14M for magenta (M) toner, a developing unit 14Y for yellow (Y) toner, an intermediate transfer belt 1F (serving as an intermediate transfer member), and a cleaning unit 17. In FIG. 4, the reference letters Bk, C, M and Y correspond to the colors of the toners, and these reference letters will hereinafter be added or omitted accordingly. The electrophotographic photoconductor 11 is an electrophotographic photoconductor having a cross-linked surface layer. The developing units 14Bk, 14C, 14M and 14Y can be independently controlled; that is, only the developing unit(s) for the color(s) of the toner(s) participating in image formation is/are driven. A toner image formed on the electrophotographic photoconductor 11 is transferred onto the intermediate transfer belt 1F by a primary transfer unit 1D placed inside the intermediate transfer belt 1F. The primary transfer unit 1D is placed in such a manner as to be able to touch and separate from the electrophotographic photoconductor 11, and the primary transfer unit 1D brings the intermediate transfer belt 1F into contact with the electrophotographic photoconductor 11 only at the time of transfer operation. After image formation using the toners of each color, a superimposed toner image formed on the intermediate transfer belt 1F is transferred at one time onto a printing medium 18 by a secondary transfer unit 1E, then the transferred image is fixed by a fixing unit 19, and image formation is thus completed. The secondary transfer unit 1E is also placed in such a manner as to be able to touch and separate from the intermediate transfer belt 1F, and the secondary transfer unit 1E comes into contact with the intermediate transfer belt 1F only at the time of transfer operation.

In an image forming apparatus employing a method with a transfer drum, toner images of each color are sequentially transferred onto a transfer target material electrostatically adsorbed onto the transfer drum, and thus there are limitations on the type of the transfer target material (for example, cardboard cannot be employed as the transfer target material). Meanwhile, in an image forming apparatus employing an intermediate transfer method as shown in FIG. 4, toner images of each color are superimposed on the intermediate transfer member 1F, and thus there are no limitations on the type of the transfer target material. Such an intermediate transfer method can be applied to the above-mentioned image forming apparatuses shown in FIGS. 1, 2 and 3 and the after-mentioned image forming apparatus shown in FIG. 5 (with its specific example shown in FIG. 6) as well as to the image forming apparatus shown in FIG. 4.

Figure 5:
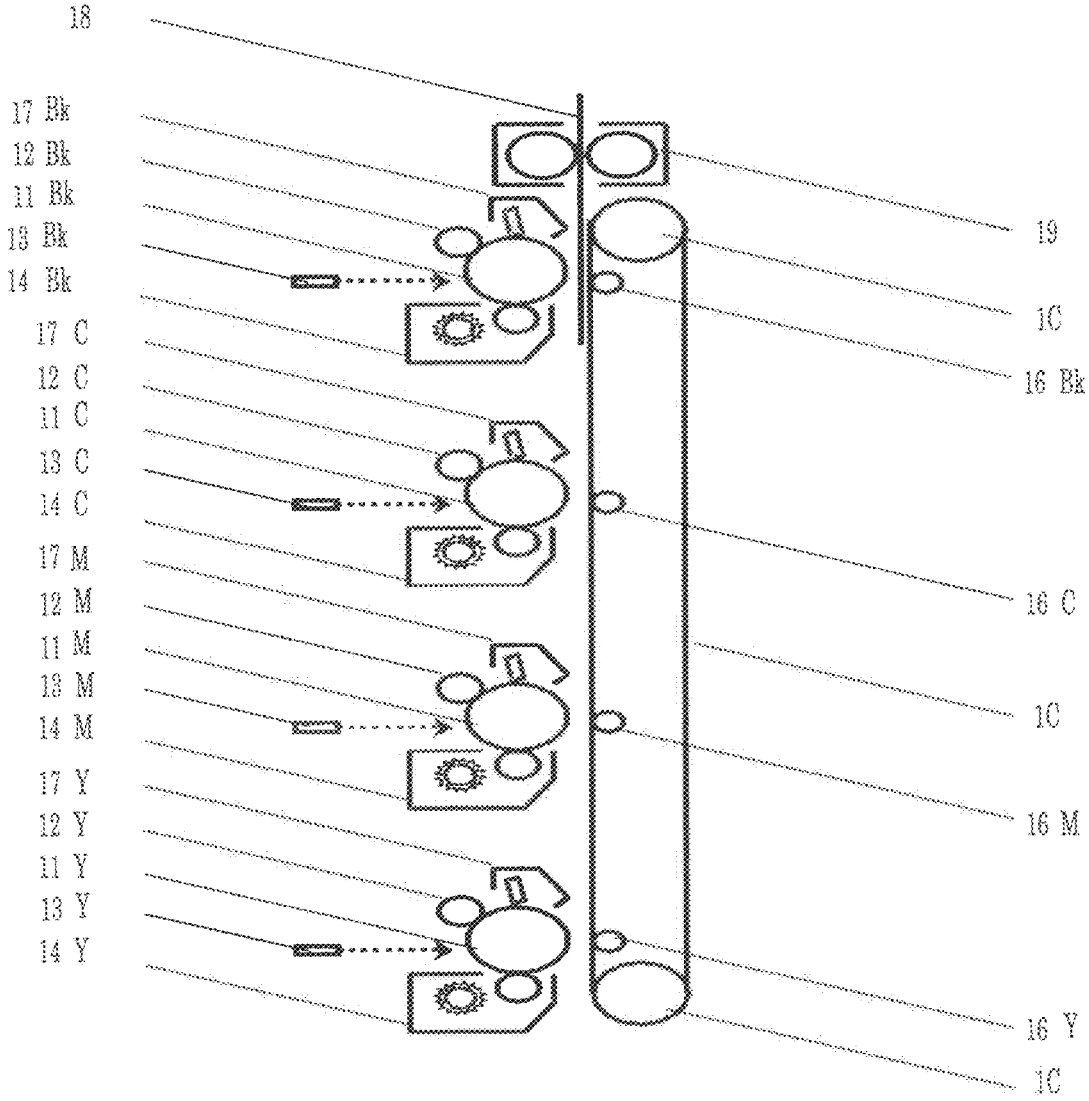
FIG. 5 is a schematic cross-sectional view showing yet another example of an image forming apparatus according to the present invention.

FIG. 5 shows yet another image forming apparatus according to the present invention. In this image forming apparatus, toners of four colors, i.e., yellow (Y) toner, magenta (M) toner, cyan (C) toner and black (Bk) toner, are used, and respective image forming units for these colors are provided. Also, electrophotographic photoconductors (11Y, 11M, 11C and 11Bk) corresponding to these colors are provided. The electrophotographic photoconductor 11 used in this image forming apparatus is an electrophotographic photoconductor having a cross-linked surface layer. Around each of the electrophotographic photoconductors (11Y, 11M, 11C and 11Bk) are provided a charging unit 12, an exposing unit 13, a developing unit 14, a cleaning unit 17, etc. Also, a conveying transfer belt 1G, serving as a transfer target material bearing member which touches and separates from the linearly disposed electrophotographic photoconductors (11Y, 11M, 11C and 11Bk) at transfer positions where transfer of toner images is to be performed, is supported by drive units 1C. Further, transfer units 16 are provided at respective transfer positions opposite the electrophotographic photoconductors (11Y, 11M, 11C and 11Bk) such that the conveying transfer belt 1G is sandwiched between these units and the photoconductors. Also, this image forming apparatus includes a fixing unit 19.

The tandem image forming apparatus shown in FIG. 5 includes electrophotographic photoconductors (1Y, 1M, 1C and 1Bk) for each color, and toner images of each color are sequentially transferred onto a printing medium 18 held on the conveying transfer belt 1G. Thus, such a tandem image forming apparatus can output full-color images at far higher speed than a full-color image forming apparatus having a single electrophotographic photoconductor.

Figure 6:
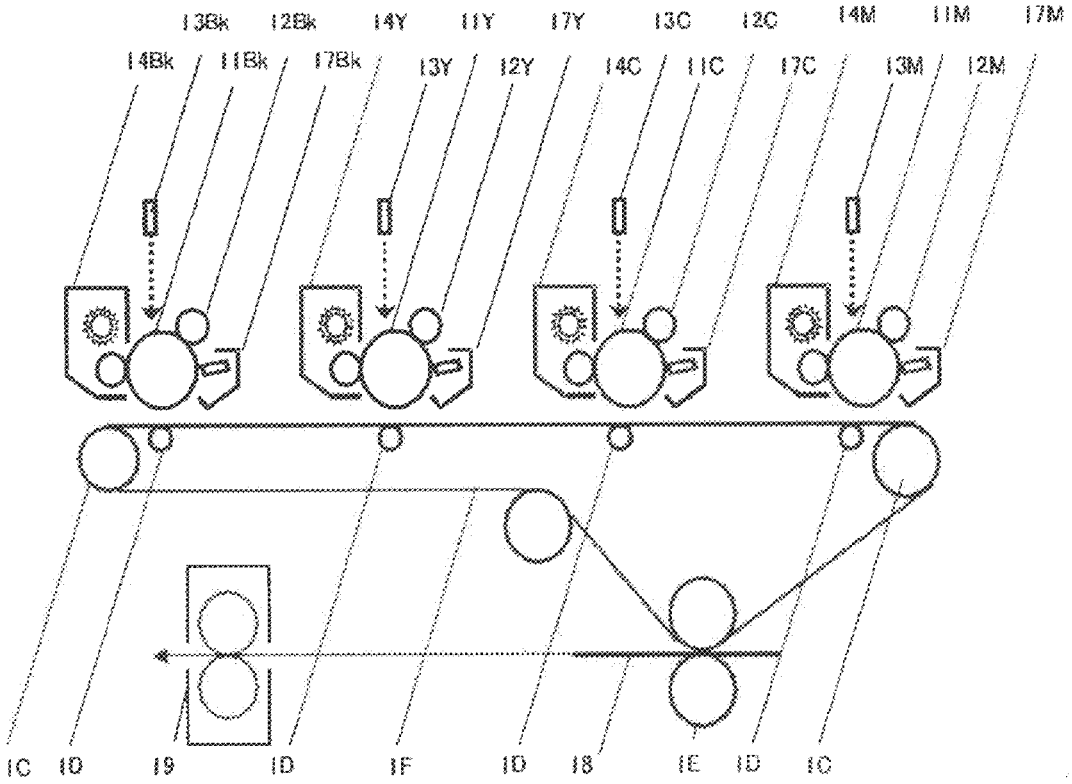
FIG. 6 is a schematic cross-sectional view showing yet another example of an image forming apparatus according to the present invention.

FIG. 6 shows yet another image forming apparatus according to the present invention. In this image forming apparatus, toners of four colors, i.e., yellow (Y) toner, magenta (M) toner, cyan (C) toner and black (Bk) toner, are used, and respective image forming units for these colors are provided. Also, electrophotographic photoconductors (11Y, 11M, 11C and 11Bk) corresponding to these colors are provided. The electrophotographic photoconductor 11 used in this image forming apparatus is an electrophotographic photoconductor having a cross-linked surface layer. Around each of the electrophotographic photoconductors (11Y, 11M, 11C and 11Bk) are provided a charging unit 12, an exposing unit 13, a developing unit 14, a cleaning unit 17, etc. Also, an intermediate transfer belt 1F, serving as a transfer target material bearing member which touches and separates from the linearly disposed electrophotographic photoconductors (11Y, 11M, 11C and 11Bk) at transfer positions where transfer of toner images is to be performed, is supported by drive units 1C. Further, primary transfer units 1D are provided at respective transfer positions opposite the electrophotographic photoconductors (11Y, 11M, 11C and 11Bk) such that the intermediate transfer belt 1F is sandwiched between these units and the photoconductors. Visible images formed on each electrophotographic photoconductor 11 are sequentially transferred by the primary transfer units 1D onto the intermediate transfer belt 1F.

Then, the images transferred onto the intermediate transfer belt 1F are transferred by a secondary transfer unit 1E onto a printing medium 18. Thereafter, the image transferred onto the printing medium 18 is fixed by a fixing unit 19.

<Lubricant Applying Unit>

The image forming apparatus includes a lubricant applying unit.

The lubricant applying unit includes a unit configured to sweep off a lubricant with a roller brush and transfer the lubricant to a surface of the electrophotographic photoconductor, and also includes a blade with which the transferred lubricant is uniformly applied over the surface of the electrophotographic photoconductor.

Figure 9:
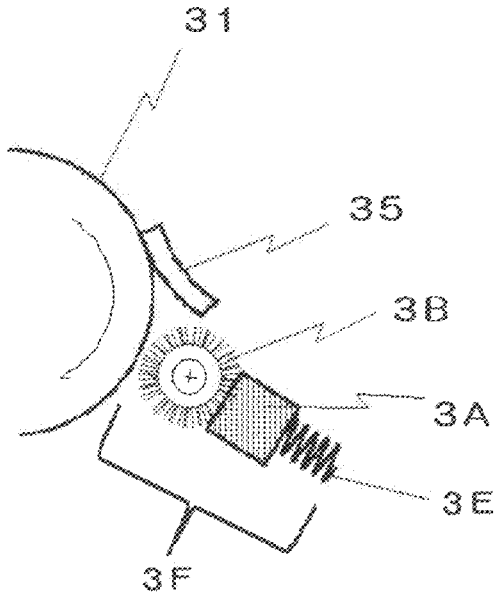
FIG. 9 is a schematic cross-sectional view showing an example of a unit configured to supply a lubricant onto an electrophotographic photoconductor.

FIG. 9 shows an example of the lubricant applying unit. This lubricant applying unit 3F has an application brush (fur brush) 3B serving as an applying member, a solid lubricant 3A, and a pressurizing spring 3E for pressing the solid lubricant 3A toward the application brush 3B. The solid lubricant 3A is a lubricant formed in the shape of a bar. The end of the application brush 3B is in contact with the photoconductor surface. While being rotated around its axis, the application brush scrapes off the solid lubricant 3A, holds this solid lubricant thereon, transfers the solid lubricant as far as the position where the application brush is in contact with the photoconductor surface, and applies the solid lubricant over the photoconductor surface. In the present invention, as a condition for exhibiting favorable lubricant applicability, it is preferable to satisfy the following photoconductor linear velocity condition: 250 to 1,000 pairs of depressions and protrusions of the electrophotographic photoconductor pass through the application blade per second; note that the depressions and the protrusions are among depressions and protrusions with dominant height differences.

Also, to keep the solid lubricant 3A in contact with the application brush 3B even when the solid lubricant 3A has become small in amount by being scraped off by the application brush 3B for a certain period of time, the solid lubricant 3A is pressed by the pressurizing spring 3E toward the application brush 3B at a predetermined pressure. Thus, even when the amount of the solid lubricant 3A is very small, it is uniformly held onto the application brush 3B.

Further, a lubricant fixing unit may be provided in order to enhance the fixability of the lubricant attached onto the photoconductor surface. Examples of this lubricant fixing unit include a unit configured to press a plate such as a cleaning blade 35 (shown in FIG. 9) against a photoconductor in accordance with a trailing method or counter method.

The solid lubricant 3A is made, for example, of a fatty acid metal salt (e.g., lead oleate, zinc oleate, copper oleate, zinc stearate, cobalt stearate, iron starate, copper stearate, zinc palmitate, copper palmitate or zinc linolenate) or a fluorine-containing resin (e.g., polytetrafluoroethylene, polychlorotrifluoroethylene, polyvinylidene fluoride, polytrifluorochloroethylene, dichlorodifluoroethylene, tetrafluoroethylene-ethylene copolymer or tetrafluoroethylene-oxafluoropropylene copolymer). In particular, stearic acid metal salts, especially zinc stearate, are preferred in that the friction coefficient of the photoconductor 31 can be effectively reduced.

EXAMPLES

The following explains the present invention by means of Examples.

First of all, tests and measuring methods involved in the present invention are described.

(1) Measurement of Shape of Electrophotographic Photoconductor Surface

The shape of the surface of each electrophotographic photoconductor was measured using a surface roughness and outline measuring apparatus (SURFCOM 1400D, manufactured by TOKYO SEIMITSU CO., LTD.) equipped with a pickup (E-DT-S02A), under the following conditions: 12 mm in measurement length and 0.06 mm/s in measurement speed. The measurement was carried out in four places per electrophotographic photoconductor.

(2) Evaluation of Image

A half-tone pattern made by forming 4 dots×4 dots in a matrix of 8×8 at a pixel density of 600 dpi×600 dpi and a blank paper pattern were printed onto five consecutive sheets of paper in an alternate manner, and background smears on the blank paper pattern were visually observed and evaluated in accordance with the following criteria.

5: Excellent (There were no background smears.)

4: Favorable (There were almost no background smears.)

3: There were background smears to such an extent that very slight somberness arose, without causing problems in practical use.

2: There were background smears to such an extent that somberness arose somewhat, without causing problems in practical use.

1: There were background smears to such an extent that somberness arose.

(3) Amount of Lubricant Attached

A part (10 mm×200 mm) of the surface of each electrophotographic photoconductor which had undergone the tests was used as a sample. The amount of zinc attached to the sample (electrophotographic photoconductor surface) was measured by ICP-AES analysis (using ICPS7500, manufactured by SHIMADZU CORPORATION). Then the amount of zinc stearate was calculated based upon the amount of the zinc.

(4) Amount of Abrasion of Cleaning Blade

An end of each cleaning blade recovered after the tests was observed using a laser microscope (VK-8500, manufactured by KEYENCE CORPORATION). The end of the cleaning blade, made of a rubber plate, was pulled in the moving direction of the electrophotographic photoconductor as it rubbed against the electrophotographic photoconductor. Thus, as the end of the cleaning blade was pulled, the part of the cleaning blade, which came into contact with the electrophotographic photoconductor was abraded. Consequently, the cleaning blade recovered had an abrasion in such a manner that the part lying between the end and a position away from the end was cut away from the cleaning blade. The extent of the abrasion was evaluated based upon the starting point of the cutaway part, expressed as the length of the cutaway part lying between the end and the position away from the end.

Example 1

A coating material for an underlayer, a coating material for a charge generating layer, a coating material for a charge transporting layer, and a coating material for a filler-reinforced charge transporting layer, having the respective compositions shown below, were sequentially applied over an aluminum drum (thickness: 0.8 mm, length: 346 mm, outer diameter: 40 mm) and dried. By doing so, an underlayer (3.5 μm in thickness), a charge generating layer (0.2 μm in thickness), a charge transporting layer (24 μm in thickness) and a filler-reinforced charge transporting layer (5 μm in thickness) were formed.

Over these layers, a cross-linked surface layer ink having the composition shown below was applied in accordance with an inkjet method. Thereafter, UV curing was carried out while rotating the drum, with the distance between the drum and a UV-curing lamp being adjusted to 120 mm. The illuminance of the UV-curing lamp at the foregoing distance was 550 mW/cm$^2$ (measured using the Accumulated UV Meter UIT-150, manufactured by USHIO INC.). The rotational speed of the drum was set at 25 rpm. At the time of the UV curing, the UV curing was carried out continuously for 4 minutes, circulating water of 30° C. in the aluminum drum. Thereafter, heating and drying were carried out at 150° C. for 30 minutes. As a result, diagonal grooves were formed in the surface of the electrophotographic photoconductor, such that each groove had a depth of 0.2 μm and a width of 60 μm, the space between each groove was 390 μm, the angle between the direction of each groove and a sub-scanning direction of the electrophotographic photoconductor was 30°, and the angle between the direction of each groove and a main scanning direction of the electrophotographic photoconductor was 60°.

As an inkjet apparatus, the inkjet head GEN3E2 (manufactured by Ricoh Printing Systems, Ltd.) was used. The writing frequency was adjusted to 310 Hz, and the distance between the head and the electrophotographic photoconductor was adjusted to 1 mm. The pulse voltage was adjusted to 20 V.

| [Coating Material for Underlayer] | |
|---|---|
| Alkyd resin solution (BECKOLITE M6401-50, manufactured by Dainippon Ink And Chemicals, Incorporated) | 12 parts by mass |
| Melamine resin solution (SUPER BECKAMINE G-821-60, manufactured by Dainippon Ink And Chemicals, Incorporated) | 8 parts by mass |
| Titanium oxide (CR-EL, manufactured by ISHIHARA SANGYO KAISHA, LTD.) | 40 parts by mass |
| Methyl ethyl ketone | 200 parts by mass |

| [Coating Material for Charge Transporting Layer] | |
|---|---|
| Z-type polycarbonate (PANLITE TS-2050, manufactured by Teijin Chemicals Ltd.) | 10 parts by mass |
| Low-molecular charge transporting material having the structure shown below | 7 parts by mass |

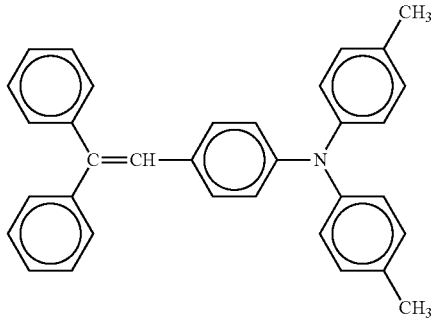

| | |
|---|---|
| Tetrahydrofuran | 100 parts by mass |
| 1% silicone oil (KF50-100CS, manufactured by Shin-Etsu Chemical Co., Ltd.) tetrahydrofuran solution | 1 part by mass |

| [Coating Material for Filler-reinforced Charge Transporting Layer] | |
|---|---|
| Z-type polycarbonate (PANLITE TS-2050, manufactured by Teijin Chemicals Ltd.) | 5.4 parts by mass |
| Low-molecular charge transporting material having the structure shown below | 3.8 parts by mass |

| [Coating Material for Charge Generating Layer] | |
|---|---|
| Bisazo pigment having the structure shown below (manufactured by Ricoh Company, Ltd.) | 5 parts by mass |

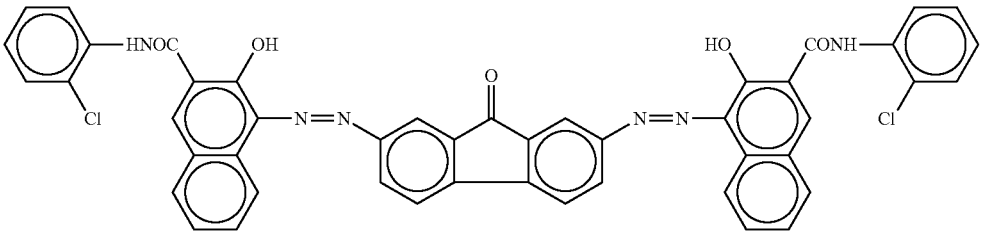

| | |
|---|---|
| Polyvinyl butyral (XYHL, manufactured by Union Carbide Corporation) | 1 part by mass |
| Cyclohexanone | 200 parts by mass |
| Methyl ethyl ketone | 80 parts by mass |

-continued

[Coating Material for Filler-reinforced Charge Transporting Layer]

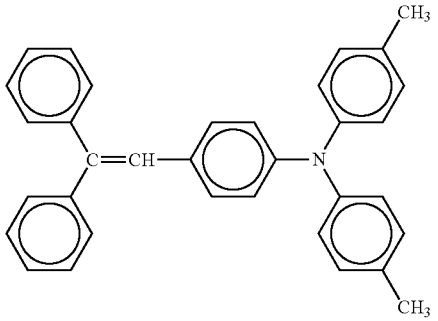

| | |
|---|---|
| α-alumina (SUMICORUNDUM AA-03, manufactured by Sumitomo Chemical Co., Ltd.) | 9 parts by mass |
| Specific resistance reducing agent (BYK-P104, manufactured by BYK-Chemie) | 0.01 parts by mass |
| Cyclohexanone | 80 parts by mass |
| Tetrahydrofuran | 280 parts by mass |

Example 21

An electrophotographic photoconductor was obtained in the same manner as in Example 1 except that the coating material for a cross-linked surface layer, shown below, was used instead of the coating material for a filler-reinforced charge transporting layer. After the application of the coating material for a cross-linked surface layer, UV curing was carried out while rotating the drum, with the distance between the drum and the UV-curing lamp being adjusted to 120 mm. The illuminance of the UV-curing lamp at the foregoing distance was 550 mW/cm$^2$ (measured using the Accumulated UV Meter UIT-150, manufactured by USHIO INC.). The rotational speed of the drum was set at 25 rpm. At the time of the UV curing, the UV curing was carried out continuously for 4 minutes, circulating water of 30° C. in the aluminum drum. Thereafter, heating and drying were carried out at 130° C. for 30 minutes.

The cross-linked surface layer had a thickness of 2 μm. Since no leveling agent was used in the cross-linked surface layer, slight coating unevenness was observed. Grooves, each having a depth of 0.2 μm, were formed. Other specifications of the grooves formed are shown in Table 1.

[Cross-linked Surface Layer Ink]

| | |
|---|---|
| Cross-linkable charge transporting material having the structure shown below | 300 parts by mass |

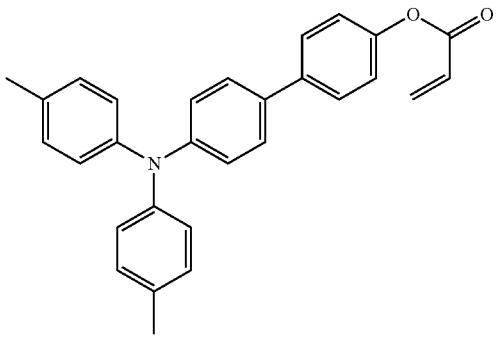

| | |
|---|---|
| Trimethylolpropane triacrylate (KAYARAD TMPTA, manufactured by Nippon Kayaku Co., Ltd.) | 150 parts by mass |
| Caprolactone-modified dipentaerythritol hexaacrylate (KAYARAD DPCA-120, manufactured by Nippon Kayaku Co., Ltd.) | 150 parts by mass |
| Acrylic leveling agent (BYK-350, manufactured by BYK-Chemie) | 0.6 parts by mass |
| 1-hydroxycyclohexyl phenyl ketone (IRGACURE 184, manufactured by Ciba Specialty Chemicals plc) | 30 parts by mass |
| Tetrahydrofuran | 2,680 parts by mass |
| Cyclohexanone | 893 parts by mass |

| [Coating Material for Cross-linked Surface Layer] | |
|---|---|
| Cross-linkable charge transporting material having the structure shown below | 300 parts by mass |

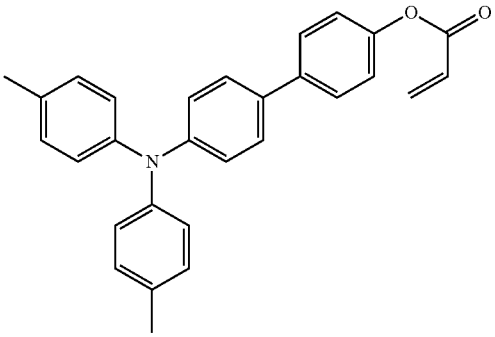

| | |
|---|---|
| Trimethylolpropane triacrylate (KAYARAD TMPTA, manufactured by Nippon Kayaku Co., Ltd.) | 150 parts by mass |
| Caprolactone-modified dipentaerythritol hexaacrylate (KAYARAD DPCA-120, manufactured by Nippon Kayaku Co., Ltd.) | 150 parts by mass |
| 1-hydroxycyclohexyl phenyl ketone (IRGACURE 184, manufactured by Ciba Specialty Chemicals plc) | 30 parts by mass |
| Tetrahydrofuran | 3,573 parts by mass |

Example 3

An electrophotographic photoconductor was obtained in the same manner as in Example 2 except that the coating material for a cross-linked surface layer was changed to the coating material shown below. Specifications of the grooves formed are shown in Table 1.

| [Coating Material for Cross-linked Surface Layer] | |
|---|---|
| Cross-linkable charge transporting material having the structure shown below | 300 parts by mass |

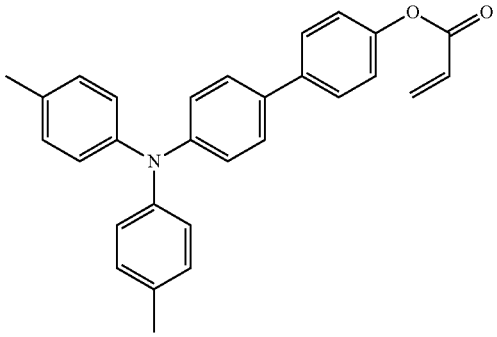

| | |
|---|---|
| Trimethylolpropane triacrylate (KAYARAD TMPTA, manufactured by Nippon Kayaku Co., Ltd.) | 150 parts by mass |
| Caprolactone-modified dipentaerythritol hexaacrylate (KAYARAD DPCA-120, manufactured by Nippon Kayaku Co., Ltd.) | 150 parts by mass |
| Acrylic leveling agent (BYK-350, manufactured by BYK-Chemie) | 0.6 parts by mass |
| 1-hydroxycyclohexyl phenyl ketone (IRGACURE 184, manufactured by Ciba Specialty Chemicals plc) | 30 parts by mass |
| Tetrahydrofuran | 3,573 parts by mass |

Example 4

An electrophotographic photoconductor was obtained in the same manner as in Example 3 except that the coating material for a cross-linked surface layer, and the cross-linked surface layer ink were respectively changed to the coating material and the ink shown below. Grooves, each having a depth of 2 μm, were formed. Other specifications of the grooves formed are shown in Table 1.

| [Coating Material for Cross-linked Surface Layer] | |
|---|---|
| Cross-linkable charge transporting material having the structure shown below | 600 parts by mass |

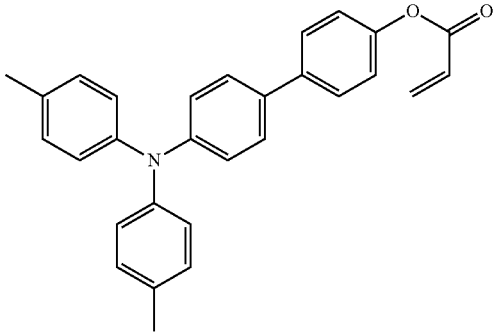

| | |
|---|---|
| Trimethylolpropane triacrylate (KAYARAD TMPTA, manufactured by Nippon Kayaku Co., Ltd.) | 150 parts by mass |
| Caprolactone-modified dipentaerythritol hexaacrylate (KAYARAD DPCA-120, manufactured by Nippon Kayaku Co., Ltd.) | 150 parts by mass |
| Acrylic copolymer (BYK-350, acrylic leveling agent, manufactured by BYK-Chemie) | 0.6 parts by mass |
| 1-hydroxycyclohexyl phenyl ketone (IRGACURE 184, manufactured by Ciba Specialty Chemicals plc) | 30 parts by mass |
| α-alumina (SUMICORUNDUM AA-03, manufactured by Sumitomo Chemical Co., Ltd.) | 60 parts by mass |
| Dispersant (DISPERBYK-2000, solid content concentration: 40%, amine value: 4 mgKOH/g, manufactured by BYK-Chemie) | 6 parts by mass |
| Tetrahydrofuran | 3,573 parts by mass |

| [Cross-linked Surface Layer Ink] | |
|---|---|
| Cross-linkable charge transporting material having the structure shown below | 600 parts by mass |

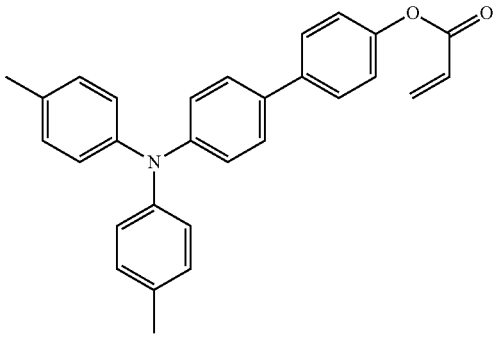

| | |
|---|---|
| Trimethylolpropane triacrylate (KAYARAD TMPTA, manufactured by Nippon Kayaku Co., Ltd.) | 150 parts by mass |

-continued

| [Cross-linked Surface Layer Ink] | |
|---|---|
| Caprolactone-modified dipentaerythritol hexaacrylate (KAYARAD DPCA-120, manufactured by Nippon Kayaku Co., Ltd.) | 150 parts by mass |
| Acrylic copolymer (BYK-350, manufactured by BYK-Chemie) | 0.6 parts by mass |
| 1-hydroxycyclohexyl phenyl ketone (IRGACURE 184, manufactured by Ciba Specialty Chemicals plc) | 30 parts by mass |
| α-alumina (SUMICORUNDUM AA-03, manufactured by Sumitomo Chemical Co., Ltd.) | 60 parts by mass |
| Dispersant (DISPERBYK-2000, solid content concentration: 40%, amine value: 4 mgKOH/g, manufactured by BYK-Chemie) | 6 parts by mass |
| Tetrahydrofuran | 2,680 parts by mass |
| Cyclohexanone | 893 parts by mass |

Example 5

An electrophotographic photoconductor was obtained in the same manner as in Example 1 except that the angle between the direction of each groove and the main scanning direction of the electrophotographic photoconductor was changed from 60° to 45°. Specifications of the grooves formed are shown in Table 1.

Example 6

An electrophotographic photoconductor was obtained in the same manner as in Example 1 except that the angle between the direction of each groove and the main scanning direction of the electrophotographic photoconductor was changed from 60° to 30°. Specifications of the grooves formed are shown in Table 1.

Comparative Example 1

An electrophotographic photoconductor was obtained in the same manner as in Example 1 except that the width of each of the grooves formed in the surface of the electrophotographic photoconductor was changed from 60 μm to 50 μm. Other specifications of the grooves formed are shown in Table 1.

Comparative Example 2

An electrophotographic photoconductor was obtained in the same manner as in Example 1 except that the width of each of the grooves formed in the surface of the electrophotographic photoconductor was changed from 60 μm to 410 μm. Other specifications of the grooves formed are shown in Table 1.

Comparative Example 3

An electrophotographic photoconductor was obtained in the same manner as in Example 3 except that the diagonal grooves formed in the surface of the electrophotographic photoconductor were changed to grooves which ran parallel to the sub-scanning direction of the electrophotographic photoconductor. Other specifications of the grooves formed are shown in Table 1.

Comparative Example 4

An electrophotographic photoconductor was obtained in the same manner as in Example 2 except that the depth of each of the grooves formed in the surface of the electrophotographic photoconductor was changed from 0.2 μm to 0.1 μm (standard deviation: 0.01). Other specifications of the grooves formed are shown in Table 1.

Comparative Example 5

An electrophotographic photoconductor was obtained in the same manner as in Example 4 except that the depth of each of the grooves formed in the surface of the electrophotographic photoconductor was changed from 2 μm to 2.2 μm (standard deviation: 0.2). Other specifications of the grooves formed are shown in Table 1.

Comparative Example 6

An electrophotographic photoconductor was obtained in the same manner as in Example 3 except that the application of the surface layer ink to the electrophotographic photoconductor in accordance with the inkjet method was omitted.

Comparative Example 7

An electrophotographic photoconductor was obtained in the same manner as in Example 1 except that the width of each groove was changed from 60 μm to 50 μm. Specifications of the grooves formed are shown in Table 1.

Comparative Example 8

An electrophotographic photoconductor was obtained in the same manner as in Example 1 except that the width of each groove was changed from 60 μm to 110 μm. Specifications of the grooves formed are shown in Table 1.

Comparative Example 9

An electrophotographic photoconductor was obtained in the same manner as in Example 1 except that the depth of each groove was changed from 0.2 μm to 0.1 μm. Specifications of the grooves formed are shown in Table 1.

Comparative Example 10

An electrophotographic photoconductor was obtained in the same manner as in Example 1 except that the depth of each groove was changed from 0.2 μm to 2.2 μm. Specifications of the grooves formed are shown in Table 1.

Comparative Example 11

An electrophotographic photoconductor was obtained in the same manner as in Example 1 except that the standard deviation of the depths of the grooves was changed from 0.008 to 0.03 by providing the groove pattern with variation. Specifications of the grooves formed are shown in Table 1.

Comparative Example 12

An electrophotographic photoconductor was obtained in the same manner as in Example 1 except that the angle between the direction of each groove and the main scanning direction of the electrophotographic photoconductor was changed from 60° to 0°. Specifications of the grooves formed are shown in Table 1.

Comparative Example 13

An electrophotographic photoconductor was obtained in the same manner as in Example 1 except that the angle between the direction of each groove and the main scanning direction of the electrophotographic photoconductor was changed from 60° to 90°. Specifications of the grooves formed are shown in Table 1.

The obtained results regarding Examples and Comparative Examples above are shown together in Table 1.

Each of the electrophotographic photoconductor drums (40 mm in diameter) of Examples 1 to 6 and Comparative Examples 1 to 13 produced as described above was prepared for practical use and then installed in a black developing station of an image forming apparatus (IPSIO SP C811, manufactured by Ricoh Company, Ltd.). Then printing was carried out onto a total of 50,000 sheets of copy paper (MY PAPER A4, manufactured by NBS Ricoh Co., Ltd.) under the following conditions: a half-tone pattern made by forming 4 dots×4 dots in a matrix of 8×8 at a pixel density of 600 dpi×600 dpi and a blank paper pattern were printed onto five consecutive sheets of the paper in an alternate manner. As a toner and a developer, products suitably produced for IPSIO SP C811 were used. The toner was a polymerization toner.

As an electrophotographic photoconductor unit, a suitably produced product was used. Regarding an AC voltage applied to a charging roller, the peak-to-peak voltage was set at 1.5 kV and the frequency was set at 0.9 kHz. Meanwhile, regarding a DC voltage applied thereto, a bias was set such that the charge potential of the electrophotographic photoconductor (at the start of a test) was −700 V, and a test was carried out under this charging condition until the test finished. A developing bias of −500 V was employed. Parenthetically, the foregoing apparatus was not provided with a charge-eliminating unit. As a cleaning unit, a suitably produced product was used, and the

TABLE 1

| | Surface layer ink | | | Grooves | | | | |
|---|---|---|---|---|---|---|---|---|
| | Charge transporting, acrylic resin with cross-linked structure | Acrylic leveling agent | Metal oxide | Width (μm) | Depth (μm) | Standard deviation of depth | Space between grooves (μm) | Direction (Angle to main scanning direction) (°) |
| Ex. 1 | Present | Present | Not Present | 60 | 0.2 | 0.008 | 390 | 60 |
| Ex. 2 | Present | Not Present | Not Present | 60 | 0.2 | 0.018 | 390 | 60 |
| Ex. 3 | Present | Present | Not Present | 100 | 0.2 | 0.01 | 390 | 60 |
| Ex. 4 | Present | Present | $\alpha$-$Al_2O_3$ | 60 | 2 | 0.01 | 390 | 60 |
| Ex. 5 | Present | Present | Not Present | 60 | 0.2 | 0.008 | 390 | 45 |
| Ex. 6 | Present | Present | Not Present | 60 | 0.2 | 0.008 | 390 | 30 |
| Comp. Ex. 1 | Present | Present | Not Present | 50 | 0.1 | 0.01 | 390 | 60 |
| Comp. Ex. 2 | Present | Present | Not Present | 410 | 0.1 | 0.01 | 390 | 60 |
| Comp. Ex. 3 | Present | Present | Not Present | 110 | 0.1 | 0.01 | 390 | 0 |
| Comp. Ex. 4 | Present | Present | Not Present | 110 | 0.1 | 0.01 | 390 | 60 |
| Comp. Ex. 5 | Present | Present | $\alpha$-$Al_2O_3$ | 110 | 2.2 | 0.02 | 390 | 60 |
| Comp. Ex. 6 | — | — | — | — | — | — | — | — |
| Comp. Ex. 7 | Present | Present | Not Present | 50 | 0.2 | 0.018 | 390 | 60 |
| Comp. Ex. 8 | Present | Present | Not Present | 110 | 0.2 | 0.008 | 390 | 60 |
| Comp. Ex. 9 | Present | Present | Not Present | 60 | 0.1 | 0.008 | 390 | 60 |
| Comp. Ex. 10 | Present | Present | Not Present | 60 | 2.2 | 0.008 | 390 | 60 |
| Comp. Ex. 11 | Present | Present | Not Present | 60 | 0.2 | 0.03 | 390 | 60 |
| Comp. Ex. 12 | Present | Present | Not Present | 60 | 0.2 | 0.008 | 390 | 0 |
| Comp. Ex. 13 | Present | Present | Not Present | 60 | 0.2 | 0.008 | 390 | 90 |

test was carried out, replacing the cleaning unit with an unused cleaning unit every time printing had been carried out onto 50,000 sheets of the paper. After the test had finished, a color test chart was copied and printed onto PPC paper (TYPE-6200 A3, manufactured by Ricoh Company, Ltd.). As for a test environment, the temperature was 25° C. and the relative humidity was 55%.

The evaluation results of the images regarding Examples and Comparative Examples above are shown in Table 2.

TABLE 2

| | Evaluation | | |
|---|---|---|---|
| | Evaluation of images | Amount of lubricant attached (μg/cm$^2$) | Starting point of cutaway part in cleaning blade (μm) |
| Ex. 1 | 4 | 0.70 | 45 |
| Ex. 2 | 4 | 0.70 | 50 |
| Ex. 3 | 5 | 0.65 | 30 |
| Ex. 4 | 5 | 0.60 | 20 |
| Ex. 5 | 5 | 0.70 | 35 |
| Ex. 6 | 4 | 0.70 | 45 |
| Comp. Ex. 1 | 3 | 1.39 | 70 |
| Comp. Ex. 2 | 3 | 1.43 | 70 |
| Comp. Ex. 3 | 2 | 1.40 | 90 |
| Comp. Ex. 4 | 2 | 1.44 | 80 |
| Comp. Ex. 5 | 1 | 1.66 | 110 |
| Comp. Ex. 6 | 1 | 1.59 | 110 |
| Comp. Ex. 7 | 2 | 1.30 | 90 |
| Comp. Ex. 8 | 2 | 1.22 | 80 |
| Comp. Ex. 9 | 2 | 1.40 | 90 |
| Comp. Ex. 10 | 1 | 1.70 | 113 |
| Comp. Ex. 11 | 2 | 1.25 | 80 |
| Comp. Ex. 12 | 1 | 1.75 | 120 |
| Comp. Ex. 13 | 3 | 1.22 | 70 |

The electrophotographic photoconductors of Examples 1 to 6 yielded higher quality printed images than printed images yielded by the electrophotographic photoconductors of Comparative Examples 1 to 13.

Regarding the amount of the lubricant attached, when 100% of the surface of each of the electrophotographic photoconductors of Examples 1 to 6 was assumed to be covered with the lubricant, it was estimated that the surface was covered with approximately one molecule of the lubricant. The amount thereof in each of Examples 1 to 6 was evaluated as an amount with little wastage. Meanwhile, regarding the surface of each of the electrophotographic photoconductors of Comparative Examples 1 to 13, it was estimated that the surface was covered with approximately three molecules of the lubricant; therefore, it was supposed that the lubricant was excessively attached to the surface or a degraded part of the lubricant remained on the surface without being removed.

When damage to each cleaning blade was observed, it was found that the extent of abrasion (formation of a cutaway part) varied according to the amount of the lubricant attached.

An electrophotographic photoconductor and an image forming apparatus according to the present invention are of high practical value, making it possible to prevent a problem in which a lubricant remains excessively on a photoconductor surface, and thus to lengthen the lifetimes of the electrophotographic photoconductor and the image forming apparatus.

What is claimed is:

1. An electrophotographic photoconductor comprising:

a conductive substrate;

a photosensitive layer; and a surface layer having grooves which do not intersect each other, the photosensitive layer and the surface layer being laid over the conductive substrate, wherein the electrophotographic photoconductor is in a form of a drum or endless belt, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor, wherein the sub-scanning direction is the direction in which the electrophotographic photoconductor moves or rotates, and the main scanning direction is the direction perpendicular to the sub-scanning direction.

2. The electrophotographic photoconductor according to claim 1, wherein bottom portions of the grooves and areas separated from each other by the grooves contain a resin having a cross-linked structure with charge transporting properties.

3. The electrophotographic photoconductor according to claim 1, wherein the surface layer contains an acrylic leveling agent.

4. The electrophotographic photoconductor according to claim 1, wherein the surface layer has an acrylate structural unit containing an acryloyloxy group, and a charge transporting structural unit.

5. The electrophotographic photoconductor according to claim 1, wherein bottom portions of the grooves and areas separated from each other by the grooves contain a metal oxide filler.

6. An image forming apparatus comprising:

at least one image forming unit which includes an exposing unit, an electrophotographic photoconductor and a lubricant applying unit, wherein the lubricant applying unit comprises a unit configured to sweep off a lubricant with a roller brush and transfer the lubricant to a surface of the electrophotographic photoconductor, and also comprises a blade with which the transferred lubricant is uniformly applied over the surface of the electrophotographic photoconductor, wherein the electrophotographic photoconductor is in a form of a drum or endless belt and comprises:

a conductive substrate;

a photosensitive layer; and a surface layer having grooves which do not intersect each other, the photosensitive layer and the surface layer being laid over the conductive substrate, wherein the grooves each have a width of 60 μm to 100 μm and a depth of 0.2 μm to 2 μm, wherein the standard deviation of the depths of the grooves is 1/10 or less of the average value of the depths of the grooves measured at any four places, and wherein the grooves are formed in a direction which diagonally crosses a main scanning direction and a sub-scanning direction of the electrophotographic photoconductor, wherein the sub-scanning direction is the direction in which the electrophotographic photoconductor moves or rotates, and the main scanning direction is the direction perpendicular to the sub-scanning direction.

7. The image forming apparatus according to claim 6, wherein bottom portions of the grooves and areas separated from each other by the grooves contain a resin having a cross-linked structure with charge transporting properties.

8. The image forming apparatus according to claim 6, wherein the surface layer contains an acrylic leveling agent.

9. The image forming apparatus according to claim 6, wherein the surface layer has an acrylate structural unit containing an acryloyloxy group, and a charge transporting structural unit.

10. The image forming apparatus according to claim 6, wherein bottom portions of the grooves and areas separated from each other by the grooves contain a metal oxide filler.

* * * * *